US011738574B2

(12) United States Patent
Liu et al.

(10) Patent No.: US 11,738,574 B2
(45) Date of Patent: Aug. 29, 2023

(54) AIRFLOW CONTROL VIA AIRFLOW ZONES IN VACUUM PLENUM OF A PRINTING SYSTEM, AND RELATED DEVICES, SYSTEMS, AND METHODS

(71) Applicant: XEROX CORPORATION, Norwalk, CT (US)

(72) Inventors: Chu-Heng Liu, Penfield, NY (US); Douglas K. Herrmann, Webster, NY (US); Jason M. LeFevre, Penfield, NY (US); Paul J. McConville, Webster, NY (US); Seemit Praharaj, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 17/218,887

(22) Filed: Mar. 31, 2021

(65) Prior Publication Data

US 2022/0314653 A1 Oct. 6, 2022

(51) Int. Cl.
*B41J 2/01* (2006.01)
*B41J 11/00* (2006.01)

(52) U.S. Cl.
CPC ..... *B41J 11/0085* (2013.01)

(58) Field of Classification Search
None
See application file for complete search history.

(56) References Cited

U.S. PATENT DOCUMENTS

| | | | |
|---|---|---|---|
| 8,388,246 | B2 | 3/2013 | Spence et al. |
| 9,944,094 | B1 | 4/2018 | Herrmann et al. |
| 10,688,778 | B2 | 6/2020 | Fromm et al. |
| 2001/0046404 | A1 | 11/2001 | Wotton et al. |

(Continued)

FOREIGN PATENT DOCUMENTS

| | | | | |
|---|---|---|---|---|
| CN | 1517229 A | * | 8/2004 | ..... B41J 11/0065 |
| EP | 1 319 510 B1 | | 9/2009 | |
| GB | 2 374 834 A | | 10/2002 | |

OTHER PUBLICATIONS

Masaaki, Tsuji, Ink-Jet Printer, Aug. 4, 2004, China, All pages (Year: 2004).*

(Continued)

*Primary Examiner* — Erica S Lin
*Assistant Examiner* — Tracey M McMillion
(74) *Attorney, Agent, or Firm* — Jones Robb, PLLC

(57) ABSTRACT

A printing system comprises a printhead to eject a print fluid to a deposition region. Print media are held against a movable support surface via vacuum suction, and the movable support surface transports the print media through the deposition region. A vacuum plenum comprises a vacuum platen over which the movable support surface moves. The vacuum platen has platen holes that communicate the vacuum suction from the vacuum plenum to the movable support surface. An airflow restriction mechanism forms a high impedance zone in the vacuum platen, the high impedance zone comprising a subset of the platen holes. The airflow impedance through the high impedance zone is relatively high compared to the airflow impedance through another subset of the platen holes, which are part of a low impedance zone. The high impedance zone may be located near the printhead to reduce airflow through uncovered platen holes near the printhead.

21 Claims, 13 Drawing Sheets

(56) References Cited

U.S. PATENT DOCUMENTS

| | | | | |
|---|---|---|---|---|
| 2011/0242220 | A1 | 10/2011 | Yamagishi et al. | |
| 2015/0273876 | A1* | 10/2015 | Soda | B41J 11/0085 347/104 |

OTHER PUBLICATIONS

Co-Pending U.S. Appl. No. 17/218,849, "Airflow Control Through Vacuum Platen of a Printing System, and Related Devices, Systems, and Methods,", Mar. 31, 2021.

* cited by examiner

AIRFLOW CONTROL VIA AIRFLOW ZONES IN VACUUM PLENUM OF A PRINTING SYSTEM, AND RELATED DEVICES, SYSTEMS, AND METHODS

FIELD

Aspects of this disclosure relate generally to inkjet printing, and more specifically to inkjet printing systems having a media transport assembly utilizing vacuum suction to hold and transport print media. Related devices, systems, and methods also are disclosed.

INTRODUCTION

In some applications, inkjet printing systems use an ink deposition assembly with one or more printheads, and a media transport assembly to move print media (e.g., a substrate such as sheets of paper, envelopes, or other substrate suitable for being printed with ink) through an ink deposition region of the ink deposition assembly (e.g., a region under the printheads). The inkjet printing system forms printed images on the print media by ejecting ink from the printheads onto the media as the media pass through the deposition region. In some inkjet printing systems, the media transport assembly utilizes vacuum suction to assist in holding the print media against a movable support surface (e.g., conveyor belt, rotating drum, etc.) of the transport device. Vacuum suction to hold the print media against the support surface can be achieved using a vacuum source (e.g., fans) and a vacuum plenum fluidically coupling the vacuum source to a side of the movable support surface opposite from the side that supports the print medium. The vacuum source creates a vacuum state in the vacuum plenum, causing vacuum suction through holes in the movable support surface that are fluidically coupled to the vacuum plenum. When a print medium is introduced onto the movable support surface, the vacuum suction generates suction forces that hold the print medium against the movable support surface. The media transport assembly utilizing vacuum suction may allow print media to be securely held in place without slippage while being transported through the ink deposition region under the ink deposition assembly, thereby helping to ensure correct locating of the print media relative to the printheads and thus more accurate printed images. The vacuum suction may also allow print media to be held flat as it passes through the ink deposition region, which may also help to increase accuracy of printed images, as well as helping to prevent part of the print medium from rising up and striking part of the ink deposition assembly and potentially causing a jam or damage.

One problem that may arise in inkjet printing systems that include media transport assemblies utilizing vacuum suction is unintended blurring of images resulting from air currents induced by the vacuum suction. In some systems, such blurring may occur in portions of the printed image that are near the edges of the print media, particularly those portions that are near the lead edge or trail edge in the transport direction (sometimes referred to as process direction) of the print media. During a print job, the print media are spaced apart from one another on the movable support surface as they are transported through the deposition region of the ink deposition assembly, and therefore parts of the movable support surface between adjacent print media are not covered by any print media. This region between adjacent print media is referred to herein as the inter-media zone. Thus, adjacent to both the lead edge and the trail edge of each print medium in the inter-media zone there are uncovered holes in the movable support surface. Because these holes are uncovered, the vacuum of the vacuum plenum induces air to flow through those uncovered holes. This airflow may deflect ink droplets as they are traveling from a printhead to the substrate, and thus cause blurring of the image.

A need exists to improve the accuracy of the placement of droplets in inkjet printing systems and to reduce the appearance of blur of the final printed media product. A need further exists to address the blurring issues in a reliable manner and while maintaining speeds of printing and transport to provide efficient inkjet printing systems.

SUMMARY

Embodiments of the present disclosure may solve one or more of the above-mentioned problems and/or may demonstrate one or more of the above-mentioned desirable features. Other features and/or advantages may become apparent from the description that follows.

In accordance with at least one embodiment of the present disclosure, a printing system comprises an ink deposition assembly comprising a printhead arranged to eject a print fluid to a deposition region of the ink deposition assembly, and a media transport assembly. The media transport assembly comprises a vacuum source, a vacuum plenum in fluidic communication with the vacuum source, and a movable support surface. The vacuum plenum comprises a vacuum platen comprising a plurality of platen holes fluidically coupling an interior of the vacuum plenum to an opening in a first surface of the vacuum platen. The movable support surface is movable over the first surface of the vacuum platen. The media transport assembly is configured hold a print medium against the movable support surface by vacuum suction communicated from the vacuum source through the platen holes to the movable support surface. The vacuum plenum comprises an airflow restriction mechanism that forms a high impedance zone in the vacuum platen, the high impedance zone comprising a first group of platen holes of the plurality of platen hole. The high impedance zone has a relatively high airflow impedance as compared to an airflow impedance of a low impedance zone of the vacuum platen comprising a second group of platen holes of the plurality of platen holes.

In accordance with at least one embodiment of the present disclosure, a method comprises loading a print medium onto a movable support surface of a media transport assembly of a printing system; holding the print medium against the movable support surface via vacuum suction; transporting the print medium in a process direction through a deposition region of a printhead of the printing system by moving the movable support surface; and ejecting print fluid from the printhead to deposit the print fluid to the print medium in the deposition region. The vacuum suction holding the print medium against the movable support surface is higher in a first zone through which the print medium is transported compared the vacuum suction in a second zone through which the print medium is transported.

BRIEF DESCRIPTION OF THE DRAWINGS

The present disclosure can be understood from the following detailed description, either alone or together with the accompanying drawings. The drawings are included to provide a further understanding of the present disclosure and are incorporated in and constitute a part of this specification. The drawings illustrate one or more embodiments of the present teachings and together with the description explain certain principles and operation. In the drawings:

FIG. 9A is a cross-sectional view, with the cross-section taken along E in FIG. 9B. FIG. 9B is a partial plan view from above a platen of the embodiment.

FIG. 10A is a cross-sectional view, with the cross-section taken along F in FIG. 10B. FIG. 10B is a partial plan view from above a platen of the embodiment.

FIG. 11A is a cross-sectional view, with the cross-section taken along G in FIG. 11B. FIG. 11B is a partial plan view from above a platen of the embodiment. FIG. 11C is a cross-sectional view, with the cross-section taken along H in FIG. 11D. FIG. 11D is a partial plan view from above the platen of the embodiment.

FIG. 12A is a cross-sectional view, with the cross-section taken along I in FIG. 12B. FIG. 12B is a partial plan view from above a platen of the embodiment.

DETAILED DESCRIPTION

In the Figures and the description herein, numerical indexes such as "_1", "_2", etc. are appended to the end of the reference numbers of some components. When there are multiple similar components and it is desired to refer to a specific one of those components, the same base reference number is used and different indexes are appended to it to distinguish individual components. However, when the components are being referred to generally or collectively without a need to distinguish between specific ones, the index may be omitted from the base reference number. Thus, as one example, a print medium 5 may be labeled and referred to as a first print medium 5_1 when it is desired to identify a specific one of the print media 5, as in FIG. 1A, but it may also be labeled and referred to as simply a print medium 5 in other cases in which it is not desired to distinguish between multiple print media 5.

Figure 1A:
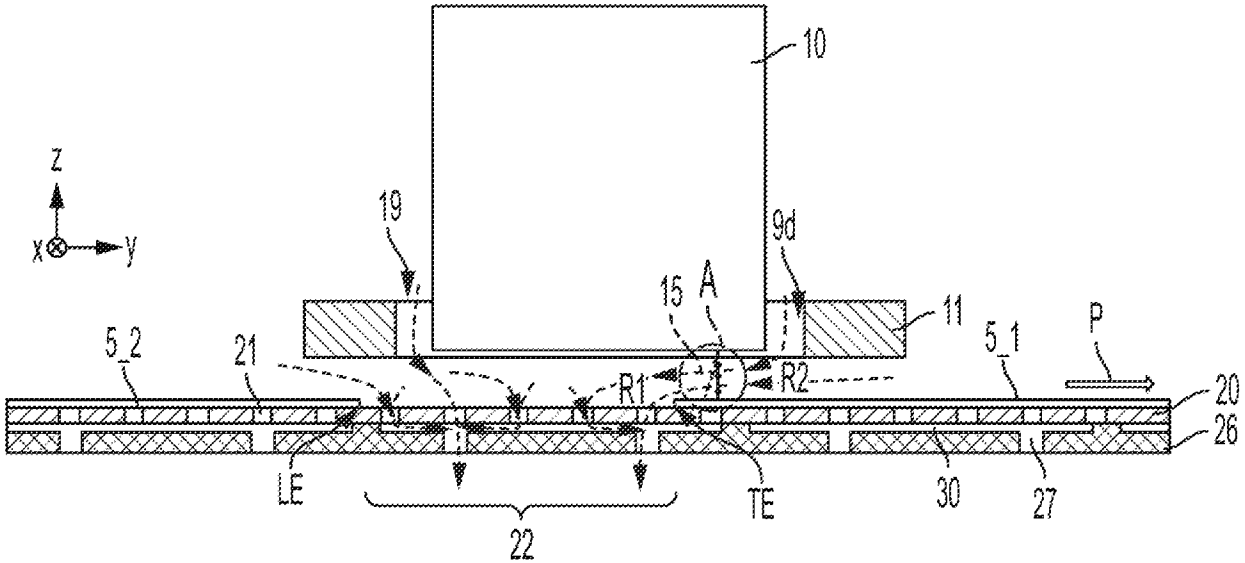
FIG. 1A RELATED ART
FIGS. 1A-1I schematically illustrate air flow patterns relative to a printhead assembly, transport device, and print media during differing stages of print media transport through an ink deposition region of a conventional inkjet printing system, and resulting blur effects in the printed media product.
Figure 1C:
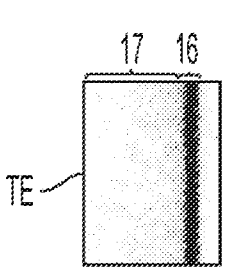
Figure 1B:
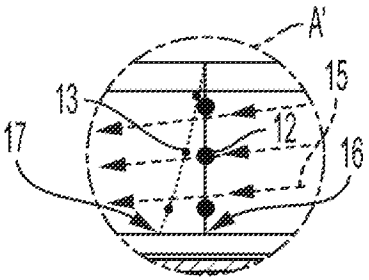
Figure 1D:
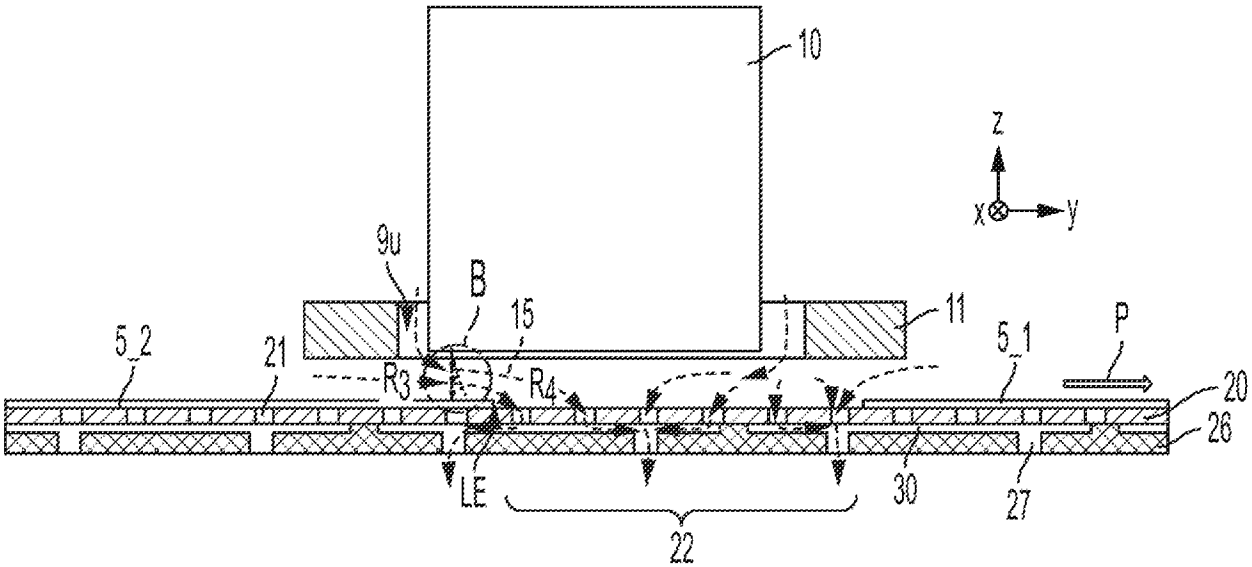
FIG. 1D RELATED ART
Figure 1F:
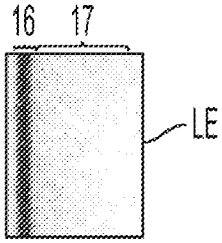
Figure 1E:
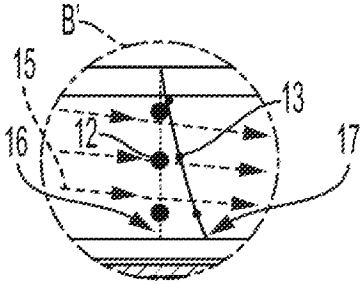
Figure 1G:
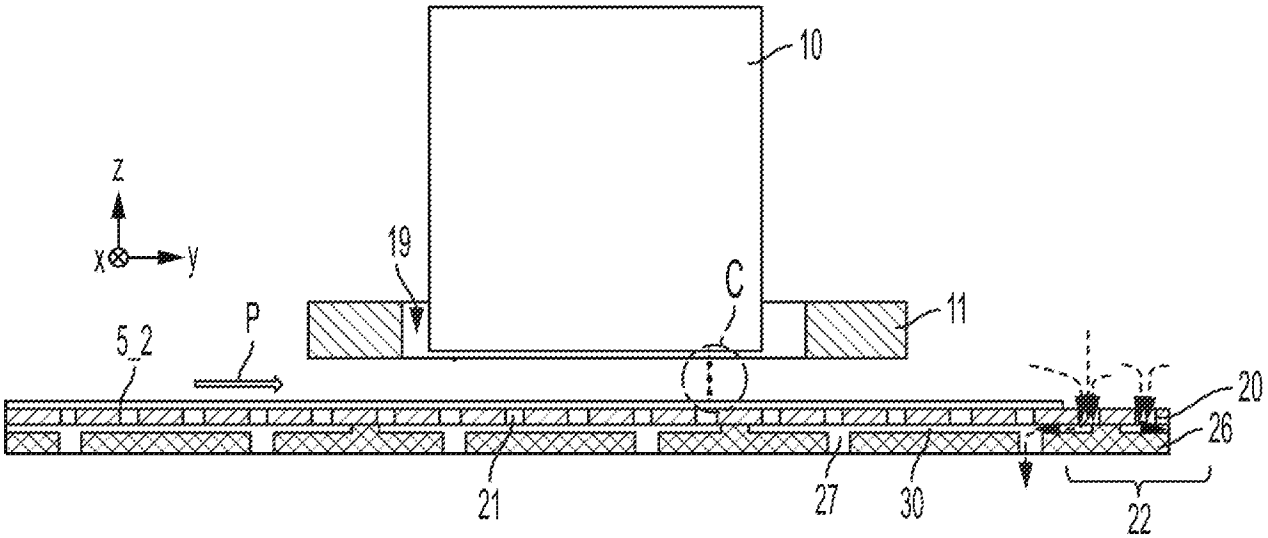
FIG. 1G RELATED ART
Figure 1I:
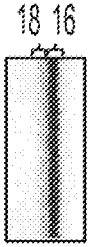
Figure 1H:
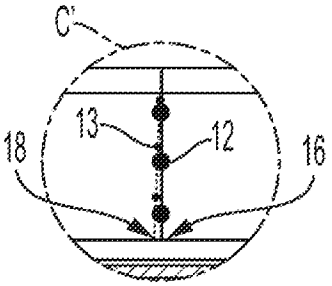

As described above, when an inter-media zone is near or under a printhead, the uncovered holes in the inter-media zone can create crossflows that can blow ink droplets ejected from a printhead off course and cause image blur. Similarly, uncovered holes along an inboard or outboard side of the print media can also create crossflows that case image blur. To better illustrate some of the phenomena occurring giving rise to the blurring issues, reference is made to FIGS. 1A-1I. FIGS. 1A, 1D, and 1G illustrate schematically a printhead 10 printing on a print medium 5 near a trail edge TE, a lead edge LE, and a middle, respectively, of the print medium 5. FIGS. 1A, 1D, and 1G are cross-sections taken through one of the printheads 10 along a process direction (y-axis direction in the figures). FIGS. 1B, 1E, and 1H illustrate enlarged views of the regions A, B, and C, of FIGS. 1A, 1D, and 1G, respectively. FIGS. 1C, 1F, and 1I illustrate enlarged pictures of printed images, the printed images comprising lines printed near the trail edge TE, lead edge LE, and middle portion, respectively, of a sheet of paper.

As shown in FIGS. 1A, 1D, and 1G, the inkjet printing system comprises one or more printheads 10 to eject ink to print media 5 (e.g., print medium 5_1 and 5_2) through printhead openings 19 in a carrier plate 11, and a movable support surface 20 that transports the print media 5 in a process direction P, which corresponds to a positive y-axis direction in the Figures. The movable support surface 20 is movable (e.g., slides) along a top of a vacuum platen 26, and a vacuum environment is provided on a bottom side of the platen 26. The vacuum platen 26 has platen holes 27 coupled to platen channels 30, with the platen holes 27 opening to the vacuum environment below the platen 26 and the platen channels 30 opening to the region above the platen 26. Thus, the platen channels 30 are open channels with the open side at the side of the platen 26 supporting the movable support surface 20. Thus, the platen holes 27 and platen channels 30 communicate vacuum to the bottom side of the movable support surface. The platen channels 30 extend in the process direction P, and each may be coupled to one or multiple holes 27. The movable support surface 20 has holes 21, with each hole 21 periodically aligning with platen channels 30 as the movable support surface 20 moves. Thus, when one of the holes 21 is located over a channel 30, the hole 21 communicates the vacuum suction from the channel 30 to the region above the movable support surface 20. In regions where the print media 5 cover the holes 21, the vacuum suction communicated through the holes 21 (via platen holes 27 and platen channels 30) generates a force that holds the print media 5 against the movable support surface 20. However, little or no air flows through these covered holes 21 since they are blocked by the print media 5. On the other hand, as shown in FIGS. 1A, 1D, and 1G, in the inter-media zone 22 between adjacent print media (e.g., between print media 5_1, 5_2), the holes 21 are not covered by any print media and therefore the vacuum suction pulls air to flow down through the uncovered holes 21. This creates airflows, indicated by the dashed arrows in FIGS. 1A, 1D, and 1G, which flow from regions around the printhead 10 towards the uncovered holes 21 and 27 in the inter-media zone 22. As shown in FIGS. 1A and 1D, when the inter-media zone 22 is near or under a printhead 10, some of the airflows induced by the inter-media zone 22 pass under the printhead 10.

In FIG. 1A, the print medium 5_1 is being printed on near its trail edge TE, and therefore the region where ink is currently being ejected ("ink-ejection region") (e.g., region A in FIG. 1A) is located downstream of the inter-media zone 22 (upstream and downstream being defined with respect to the process direction P, which is the direction of transport of the print media by the movable support surface 20). Accordingly, some of the air being sucked towards the inter-media zone 22 will flow upstream through the ink-ejection region A. More specifically, the vacuum suction from the inter-media zone 22 lowers the pressure in the region immediately above the inter-media zone 22, e.g., region $R_1$ in FIG. 1A, while the region downstream of the printhead 10, e.g., region $R_2$ in FIG. 1A, remains at a higher pressure. This pressure gradient causes air to flow in an upstream direction from the region $R_2$ to the region $R_1$, with the airflows crossing through the ink-ejection region (e.g., region A in FIG. 1A) which is between the regions $R_1$ and $R_2$. Some of this air may be pulled from the gap 9*d* between the downstream face of the printhead 10 and a rim of the opening 19 through which the printhead 10 ejects ink. Airflows such as these, which cross through the ink-ejection region, are referred to herein as crossflows 15. In FIG. 1A, the crossflows 15 flow upstream, but in other situations the crossflows 15 may flow in different directions.

As shown in the enlarged view A' in FIG. 1B, which comprises an enlarged view of the region A, as ink is ejected from the printhead 10 towards the medium 5, main ink droplets 12 and satellite ink droplets 13 are formed. The satellite droplets 13 are much smaller than the main droplets 12 and have less mass and momentum, and thus the upstream crossflows 15 tend to affect the satellite droplets 13 more than the main droplets 12. Thus, while the main droplets 12 may land on the print medium 5 near their intended deposition location 16 regardless of the crossflows 15, the crossflows 15 may push the satellite droplets 13 away from the intended trajectory so that they land at an unintended location 17 on the medium 5, the unintended location 17 being displaced from the intended location 16. The effect of this can be seen in an actual printed image in FIG. 1C, in which the denser/darker line-shaped portion is formed by the main droplets which were deposited predominantly at their intended locations 16, whereas the smaller dots dispersed away from the line are formed by satellite droplets which were blown away (in the negative y-axis direction) from the intended locations 16 to land in unintended locations 17, resulting in a blurred or smudged appearance for the printed line. Notably, the blurring in FIG. 1C is asymmetrically biased towards the trail edge TE of the paper shown, which would be due to the crossflows 15 near the trail edge TE blowing primarily in an upstream direction depicted in FIGS. 1A and 1B. The inter-media zone 22 may also induce other airflows flowing in other directions, such as downstream airflows from an upstream side of the printhead 10, but these other airflows do not pass through the region where ink is currently being ejected in the illustrated scenario and thus do not contribute to image blur. Only those airflows that cross through the ink ejection region are referred to herein as crossflows.

FIGS. 1D-1F illustrate another example of such blurring occurring, but this time near the lead edge LE of the print medium 5_2. The cause of blurring near the lead edge LE as shown in FIGS. 1C and 1D is similar to that described above in relation to the trail edge TE, except that in the case of printing near the lead edge LE the ink-ejection region is now located upstream of the inter-media zone 22. As a result, the crossflows 15 that are crossing through the ink-ejection region now originate from the upstream side of the printhead 10, e.g., from region $R_3$, and flow downstream to region $R_4$ where the uncovered holes 21, 27 of the inter-media zone 22 adjacent the lead edge LE are. For example, air may be pulled from the gap 9*u* between the upstream face of the printhead 10 and the rim of the opening 19 of the carrier plate 11. Thus, as shown in the enlarged view B' of FIG. 1E, which comprises an enlarged view of the ink ejection region B, in the case of printing near the lead edge LE, the satellite droplets 13 are blown downstream towards the lead edge LE of the print medium 5_2 (positive y-axis direction). As shown in FIG. 1F, such a phenomenon results in asymmetric blurring that is biased towards the lead edge LE, in which satellite droplets get deposited at undesired locations 17 relative to the intended location 16.

In contrast, as shown in FIG. 1G and the enlarged view C' in FIG. 1H which corresponds to an enlarged view of ink ejection region C, when a print medium (e.g., print medium 5_2) is being printed on in a middle portion, farther from the trail and lead edges TE, LE, there may be little or no crossflows 15 because the inter-media zone 22 and the uncovered region 24 are too distant from the printhead 10 and the ink-ejection region D to induce much airflow near the ink-ejection region D. Because the crossflows 15 are absent or weak farther away from the edges of the print medium 5, the satellite droplets 13 in this region are not as likely to be blown off course. Thus, as shown in FIGS. 1H and 1I, when printing farther from the edges of the print medium 5_2, the satellite droplets land at locations 18 that are much closer to the intended locations 16 resulting in much less image blurring. The deposition locations 18 of the satellite droplets may still vary somewhat from the intended locations 16, due to other factors affecting the satellite droplets, but the deviation is smaller than it would be near the lead or trail edges, thus not resulting in as noticeable blurring.

Embodiments disclosed herein may, among other things, inhibit some of the crossflows so as to reduce the image blur that may result from such crossflows. By inhibiting crossflows, the droplets ejected from a printhead (including, e.g., the satellite droplets) are more likely to land closer to or at their intended deposition locations, and therefore the amount of blur can be reduced. In accordance with various embodiments, the vacuum plenum is divided into airflow zones, with each airflow zone regulating airflow through the platen holes which are in the respective airflow zone. The airflow zones include at least one high impedance zone and at least one low impedance zone, with high impedance zone(s) having a relatively high impedance as compared to the low impedance zone(s). To provide such relatively high and relatively low impedance zones, the present disclosure contemplates using an airflow restriction mechanism in each high impedance zone that impedes the overall airflow through the platen holes in the respective high impedance zone. In some embodiments, the airflow restriction mechanism comprises one or more airflow impeding structures which are positioned in the vacuum plenum between the platen holes and the vacuum source or within the platen holes or platen channels themselves. Such airflow impeding structures are configured to reduce but not fully block airflow through the platen holes. Suitable airflow impeding structures may include, but are not limited to, a porous material (e.g., a sponge, a filter), a mesh (e.g., a wire mesh screen), a fabric, a fin array (e.g., skived fins), a pin array, a pin-fin array, one or more baffles, one or more walls with one or more apertures, an array of fibers (e.g., a brush), or any combination thereof. In some embodiments, in lieu of or in addition to an airflow impeding structure, the airflow restriction mechanism comprises a change in the configuration of the platen holes themselves as between the high and low impedance zones. For example, in some embodiments the airflow restriction mechanism comprises the platen holes in the high impedance zones each having a relatively smaller cross-sectional area than the platen holes in the low impedance zones. As another example, in some embodiments the airflow restriction mechanism comprises the platen holes in the high impedance zone having a lower hole density (number of platen holes per unit of area) than in the low impedance zone. The use of the airflow restriction mechanisms in the high impedance zones can significantly reduce the rate at which air flows through the platen holes in those zones, while the omission of the airflow restriction mechanisms in the low impedance zones can provide for higher airflow rates in those zones.

The high impedance zones and the low impedance zones may be arranged within the vacuum plenum so as to provide different airflow rates at different locations of the platen. In various embodiments, the high impedance zones are provided near each printhead. Such an arrangement reduces the strength with which air is pulled into the platen holes near the printheads when they are located in the inter-media zone, thus reducing the strength of the crossflows induced by the inter-media zone. With the crossflows reduced in strength, the ink droplets (including the satellite droplets) are more likely to land at or nearer to their intended deposition locations, and therefore the amount of blur near that edge of the print media is reduced.

On the other hand, high airflow rates may be desired in some locations, such as a location where the print media are loaded onto the movable support surface. High airflow rates may be needed to initially suction a print media to the movable support surface. Once adhered to the movable support surface less airflow may be needed to maintain the print media a held-down state of the print media. Thus, in some embodiments, a low impedance zone may be provided at a location where print media are initially loaded onto the movable support surface to facilitate the suction of print media to the movable support surface. Low impedance zones may also be provided at other locations where higher airflow rates are desired and/or which are not located near (e.g., under) the printheads. Because the low impedance zones are not located near (e.g., under) the printheads, the relatively high airflow rates in these zones are unlikely to contribute very much to the crossflows around the printheads, and thus do not affect image blur very much.

Increasing the impedance in the high impedance zones also reduces the amount of hold down force that is applied to the print media in these zones. However, this reduction in hold down force is relatively small. As the impedance in the high impedance zone is increased, the airflow rate decreases faster than the hold down force decreases. Thus, significant reductions in the rate of airflow through the high impedance zones can be obtained by increasing their impedance, while only modestly decreasing the hold down force in these zones. For example, in some systems airflow rates may be reduced in the high impedance zones to one quarter the flow rate in low impedance zones, while still maintaining around 85% of the suction force. Moreover, it has been found that, although significant suction may be needed to initially adhere a print medium to the movable support surface, once a print medium is adhered to the movable support surface relatively less suction is needed to continue to hold the print media against the movable support surface. Because the high impedance zones are generally not located where the print media have are loaded on the movable support surface, relatively less suction force is needed in the high impedance zones to maintain the print medium against the movable support surface. Thus, despite the small reductions in hold down force that occur in the high impedance zones, sufficient suction to adhere the print media to the movable support surface may be provided.

Thus, by arranging the high impedance zones near printheads as described above, airflow rates through uncovered holes of the vacuum platen can be reduced near the printheads, thus combatting image blur, while still providing sufficient hold down force for the print media. Moreover, the low impedance zones may provide for higher airflow rates at locations more distant from the printheads, thus allowing for beneficial effects of higher airflow rates (such as facilitating initial suctioning of print media to the movable support surface) without contributing much to image blur.

Figure 2:
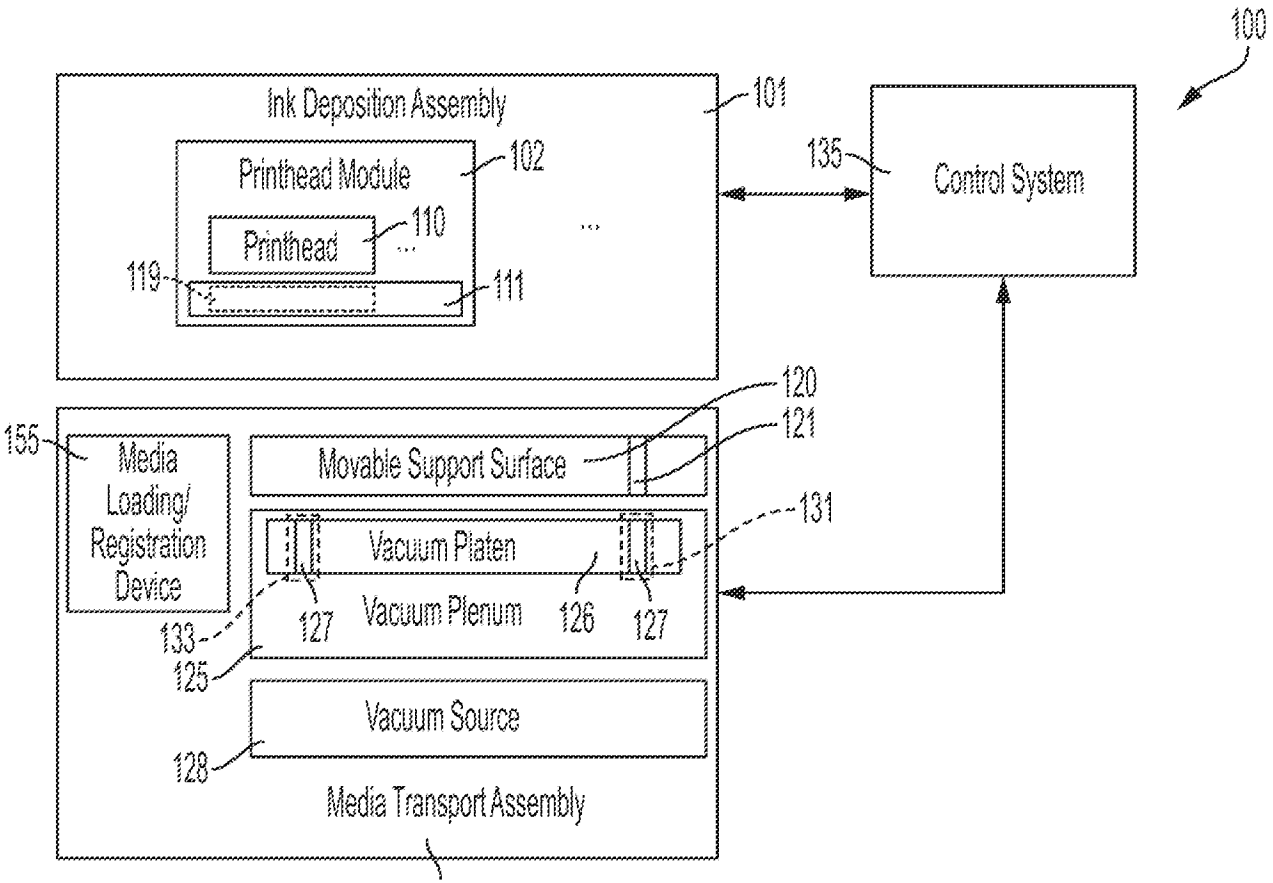
FIG. 2 is a block diagram illustrating components of an embodiment of an inkjet printing system including an air flow control system.

Turning now to FIG. 2, an embodiment of a printing system will be described in greater detail. FIG. 2 is a block diagram schematically illustrates a printing system 100 utilizing the above-described platen configured with differing zones of airflow impedance. The printing system 100 comprises an ink deposition assembly 101 to deposit ink on print media, a media transport assembly 103 to transport print media through the ink deposition assembly 101, and a control system 135 to control operations of the printing system 100.

The ink deposition assembly 101 comprises one or more printhead modules 102. One printhead module 102 is illustrated in FIG. 2 for simplicity, but any number of printhead modules 102 may be included in the ink deposition assembly 101. In some embodiments, each printhead module 102 may correspond to a specific ink color, such as cyan, magenta, yellow, and black. Each printhead module 102 comprises one or more printheads 110 configured to eject print fluid, such as ink, onto the print media to form an image. In FIG. 2, one printhead 110 is illustrated in the printhead module 102 for simplicity, but any number of printheads 110 may be included per printhead module 102. The printhead modules 102 may comprise one or more walls, including a bottom wall which may be referred to herein as a carrier plate 111. The carrier plate 111 comprises printhead openings 119, and the printheads 110 are arranged to eject their ink through the printhead openings 119. In some embodiments, the carrier plate 111 supports the printheads 110. In other embodiments, the printheads 110 are supported by other structures. The printhead modules 102 may also include additional structures and devices to support and facilitate operation of the printheads 110, such as, ink supply lines, ink reservoirs, electrical connections, and so on, as known in the art.

As shown in FIG. 2, the media transport assembly 103 comprises a movable support surface 120, a vacuum plenum 125, a vacuum source 128, and a media loading/registration device 155. The movable support surface 120 transports the print media through a deposition region of the ink deposition assembly 101. The vacuum plenum 125 supplies vacuum suction from the vacuum source 128 to one side of the movable support surface 120 (e.g., a bottom side), and print media is supported on an opposite side of the movable support surface 120 (e.g., a top side). Holes 121 through the movable support surface 120 communicate the vacuum suction through the surface 120, such that the vacuum suction holds down the print media against the surface 120. The media loading/registration device 155 loads the print media onto the movable support surface 120 and registers the print media.

The movable support surface 120 is movable relative to the ink deposition assembly 101, and thus the print media held against the movable support surface 120 is transported relative to the ink deposition assembly 101 as the movable support surface 120 moves. Specifically, the movable support surface 120 transports the print media through a deposition region of the ink deposition assembly 101, the deposition region being a region in which print fluid (e.g., ink) is ejected onto the print media, such as a region under the printhead(s) 110. The movable support surface 120 can comprise any structure capable of being driven to move relative to the ink deposition assembly 101 and which has holes 121 to allow the vacuum suction to hold down the print media, such as a belt, a drum, etc.

The vacuum plenum 125 comprises baffles, walls, or any other structures arranged to enclose or define an environment in which a vacuum state (e.g., low pressure state) is maintained by the vacuum source 128, with the plenum 125 fluidically coupling the vacuum source 128 to the movable support surface 120 such that the movable support surface 120 is exposed to the vacuum state within the vacuum plenum 125. The vacuum plenum 125 comprises a vacuum platen 126, which forms a top wall of the vacuum plenum 125 and supports the movable support surface 120. The vacuum platen 126 comprises platen holes 127, which fluidically couple an interior of the vacuum plenum 125 to an opening in a first surface of the vacuum platen 126, the first surface being adjacent the movable support surface 120. Thus, the movable support surface 120 is fluidically coupled to the vacuum in the plenum 125 through the vacuum platen 126 via the platen holes 127. The vacuum source 128 may be any device configured to remove air from the plenum 125 to create the low-pressure state in the plenum 125, such as a fan, a pump, etc.

As noted above, the platen holes 127 are fluidically coupled to an opening in the first surface (e.g., top surface) of the vacuum platen 127. These opening in the first surface may be openings of the platen holes 127 themselves, or they may be openings of channels in the first surface of the vacuum platen 126. The openings in the first surface of the platen 126 (i.e., the openings of the platen holes 127 and/or the channels) are arranged in columns that extend in the process direction, the columns being distributed across the vacuum platen 126 in the cross-process direction. The holes 121 in the movable support surface 120 are aligned in the process direction with corresponding columns of holes 127 (and/or channels), and thus as the movable support surface 120 moves relative to the vacuum platen 126, each respective hole 121 moves sequentially over each of the holes 127 (and/or channels) in the respectively corresponding column. When a hole 121 is located above a platen hole 127 (and/or channel), the vacuum suction is communicated from the vacuum plenum 125 through the platen hole 127 (and corresponding channel, if present) and the hole 121 to the region above the given hole 121. If a print medium is located above the hole 121, then the vacuum suction communicated through the hole 121 generates a suction force on the print media that pulls the print media towards the movable support surface 120. If no print medium is located above the hole 121, then the vacuum suction induces air from above the movable support surface 120 to flow down through the hole 121 and the hole 127 into the vacuum platen 126.

The vacuum plenum 125 further comprises a plurality of airflow zones, including at least one high impedance zone 131 and at least one low impedance zone 133. The airflow zones comprise platen holes 127, and in some cases additional structures, to regulate airflow through a corresponding region of the vacuum platen 126, with the high impedance zones having a relatively higher airflow impedance than the low impedance zones, as described above. The higher airflow impedance of the high impedance zone 131 is provided by using airflow restriction mechanism, as described above. In some embodiments, the airflow restriction mechanism comprises one or more airflow impeding structures that are arranged below or within the platen holes 127 of a high impedance zone 131 to provide relatively high impedance to air flow through those platen holes 127 (collectively). Airflow impeding structures may comprise any structures arranged to inhibit airflow from a first side of the vacuum platen 126 (e.g., the top side) through the platen holes 127 in the respective high impedance zone 131 to the interior of the vacuum plenum 125, without fully blocking such airflow. For example, suitable airflow impeding structures may comprise a block or plate of porous material (e.g., a sponge, filter, perforated plate), a mesh (e.g., a wire mesh), a fabric, fins (e.g., skived fins), pins, a pin-fin array, a filter, a series of baffles, a wall or walls with one or more apertures, an array of fibers (e.g., a brush), etc. In some embodiments, in addition to or in lieu of using the airflow impeding structures as the airflow restriction mechanism, the airflow restriction mechanism comprises configuration of the platen holes 127 themselves. In other words, the airflow restriction mechanism comprises the platen holes 127 of a high impedance zone 131 having a first configuration while the platen holes 127 of a low impedance zone 133 have a second configuration, which is different from the first configuration. In some embodiments, the first configuration comprises some or all of the platen holes 127 in the high impedance zone 131 having a first cross-sectional area while the second configuration comprises the platen holes 127 in the low impedance zone 133 having a second cross-sectional area, where the first cross-sectional area is smaller than the second cross-sectional area. In other words, in some embodiments the airflow restriction mechanism comprises the platen holes 127 in the high impedance zone 131 being smaller than the platen holes 127 in the low impedance zone 133. As another example, in some embodiments the first configuration comprises the platen holes 127 in the high impedance zone 131 having first hole density (number of platen holes per unit of area) while the second configuration comprises the platen holes 127 in the low impedance zone 133 having a second hole density, the first hole density being smaller than the second hole density. In some embodiments, both the airflow impeding structures and the different configurations of platen holes are used together as the airflow restriction mechanism. The use of any of the forgoing airflow restriction mechanism s in the high impedance zones 131 can significantly reduce the rate at which air flows through the platen holes 127 in those zones, while the omission of the airflow restriction mechanism s in the low impedance zones 133 can provide for higher airflow rates in those zones.

Herein, airflow rates through different zones (e.g., zones 131 and 133) or different groups of platen holes (e.g., the platen holes 127 in the zones 131 and 133) are referred to. Unless otherwise specified, the airflow rates refer to an average per-hole airflow rate in the zone or group, when the platen holes in the zone or group are not covered by a print medium. Airflow rates may depend on various factors in addition to the impedance of the zones, such as the number and sizes of print media on the movable support surface, the strength of suction from the vacuum source, etc. However, in comparisons of airflow rates through different zones, it may be assumed that the other factors are held constant between the zones or groups. Thus, when it is said that a high impedance zone has a lower airflow rate than a low impedance zone, this should be understood as meaning that, all other factors being equal, the average per-hole airflow rate in the uncovered high impedance zone is lower than the average per-hole airflow rate in the uncovered low impedance zone.

The high impedance zones 131 and the low impedance zones 133 are arranged within the vacuum plenum 125 so as to provide different airflow rates at different locations of the platen 126. In particular, in some embodiments, the high impedance zones 131 are provided at least near each printhead 110. In some embodiments, each platen hole 127 that is located directly under one of the printheads 110 is included in one of the high impedance zones 131. In some embodiments, platen hotels 127 that are immediately adjacent to (e.g., within a threshold distance from) a printhead 110 are also included in the high impedance zones 131. In some embodiments, a separate high impedance zone 131 is provided for each printhead 110. In some embodiments, a separate high impedance zone 131 is provided for each printhead module 102, and the printheads 110 within a printhead module 102 may share the same high impedance zone 131. In some embodiments, a single high impedance zone may be provided for an entire ink deposition region of a printhead assembly.

The low impedance zones 133 may include at least one low impedance zone 133 that is positioned in a region where print media are initially loaded onto the movable support surface 120. This low impedance zone 133 may provide relatively high suction around the print media as they are loaded onto the movable support surface 120, which facilitates adhering the print media to the movable support surface 120. Additional low impedance zones 133 may also be provided in spaces between the high impedance zones 131. For example, in some embodiments, low impedance zones 131 are provided in the spaces between adjacent printhead modules 102. In some embodiments, low impedance zones 131 can also be provided under the carrier plate 111 of a printhead module 102, such as in regions that are not under one of the printheads 110. Providing low impedance zones 133 between the high impedance zones 131 can help to prevent problems caused by air leakage and restore the hold down force applied to the print medium, which may help to ensure the print medium does not lift off the movable support surface 120.

Those having ordinary skill in the art would appreciate the numbers, sizes, shapes, and/or locations of the high and low impedance zones 131, 133 may be varied from one system to the next to provide a desired balance between reducing airflow to combat image blur and maintaining sufficiently strong vacuum suction to hold down the print media on the movable support surface. Thus, by providing high impedance zones 131 and low impedance zones 133 as described above, airflow rates through the vacuum platen 126 can be reduced near the printheads 110, thus combatting image blur, while still providing sufficient suction to adhere the print media to the movable support surface 120.

As noted above, the media loading/registration device 155 loads the print media onto the movable support surface 120 and registers the print media relative to various registration datums, as those of ordinary skill in the art are familiar with. For example, as each print medium is loaded onto the movable support surface 120, and one edge of each print medium may be registered to (i.e., aligned with) a process-direction registration datum that extends in the process direction. Herein, whichever side of the media transport assembly 103 is closest to the process-direction registration datum is referred to as the outboard side of the media transport assembly 103 and the edge that is registered to this datum is referred to as the outboard edge, while the opposite side of the device is referred to as the inboard side and the opposite edge is referred to as the inboard edge. In practice, the registration datum could be located on either side of the media transport assembly 103, and thus the side of the media transport assembly 103 that is considered the outboard side will vary from system to system (or from time to time within the same system) depending on which side the print media happen to be registered to. In addition, the lead and/or trail edges of the print media may be registered to various cross-process datums along the movable support surface 120 as the print media are loaded thereon. Thus, by registering each print medium to the process-direction registration datum and one of the cross-process registration datums, a precise location and orientation of the print medium relative to the movable support surface 120 may be enforced, thus allowing for accurate printing of images on the print medium. Various media loading/registration devices for loading print media onto a movable support surface and registering the print media relative to the movable support surface are known in the art and used in existing printing systems. Any existing media loading/registration device, or any new media loading/registration device, may be used as the media loading/registration device 155. Because the structure and function of such media loading/registration devices are well known in the art, further detailed description of such systems is omitted.

The control system 135 comprises processing circuitry to control operations of the printing system 100. The processing circuitry may include one or more electronic circuits configured with logic for performing the various operations described herein. The electronic circuits may be configured with logic to perform the operations by virtue of including dedicated hardware configured to perform various operations, by virtue of including software instructions executable by the circuitry to perform various operations, or any combination thereof. In examples in which the logic comprises software instructions, the electronic circuits of the processing circuitry include a memory device that stores the software and a processor comprising one or more processing devices capable of executing the instructions, such as, for example, a processor, a processor core, a central processing unit (CPU), a controller, a microcontroller, a system-on-chip (SoC), a digital signal processor (DSP), a graphics processing unit (GPU), etc. In examples in which the logic of the processing circuitry comprises dedicated hardware, in addition to or in lieu of the processor, the dedicated hardware may include any electronic device that is configured to perform specific operations, such as an Application Specific Integrated Circuit (ASIC), a Field Programmable Gate Array (FPGA), a Complex Programmable Logic Device (CPLD), discrete logic circuits, a hardware accelerator, a hardware encoder, etc. The processing circuitry may also include any combination of dedicated hardware and general-purpose processor with software.

Figure 3:
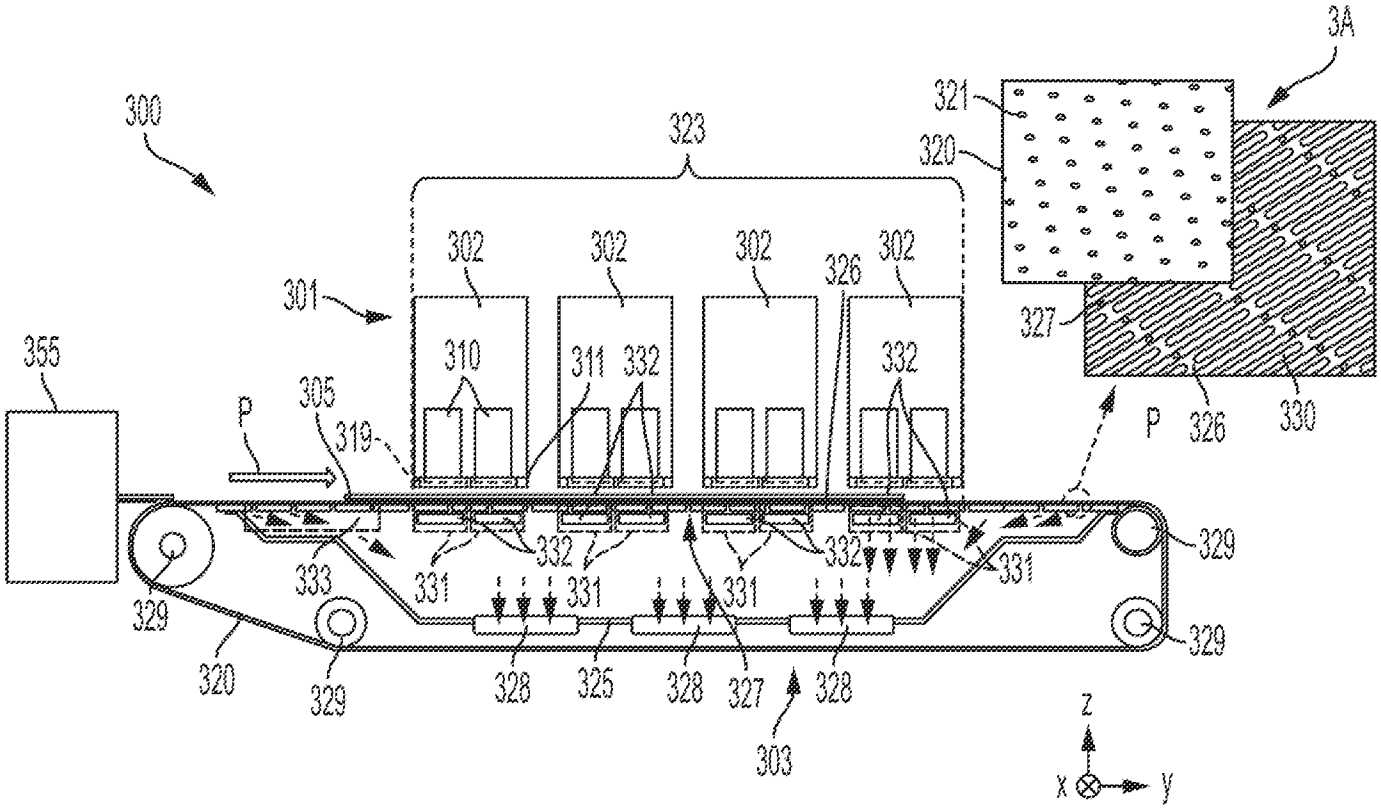
FIG. 3 is a schematic illustration of an ink deposition assembly and media transport assembly of one embodiment of an inkjet printing system.
Figure 4:
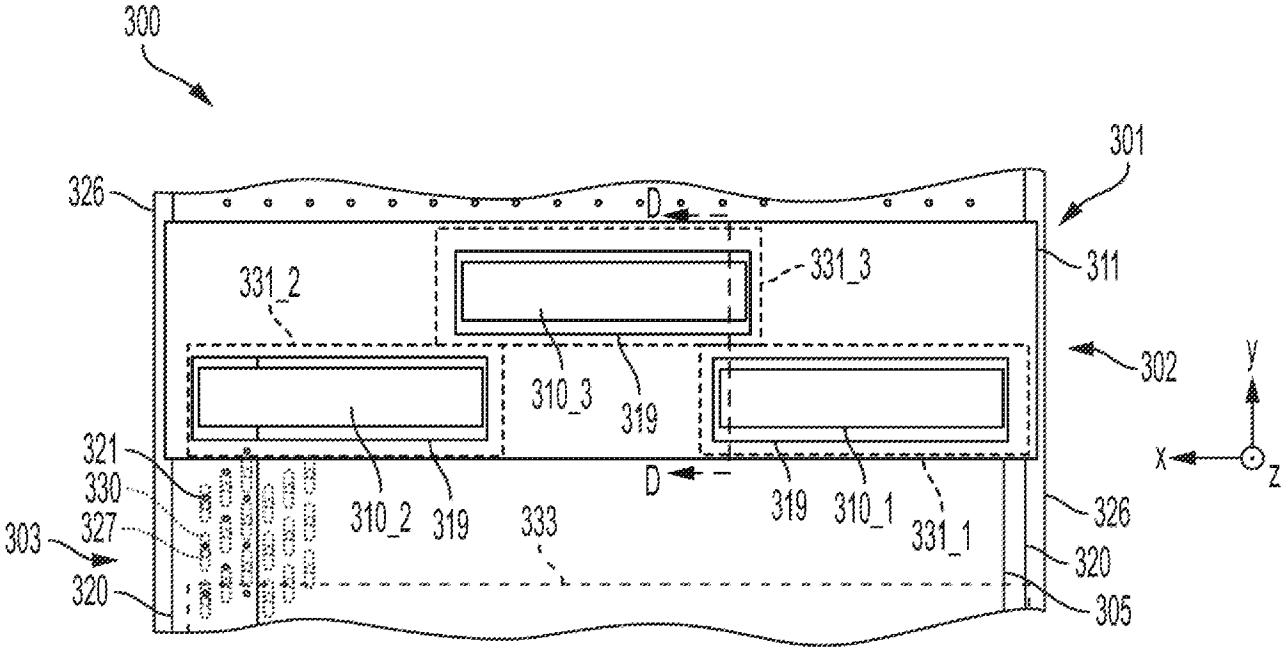
FIG. 4 is a partial plan view from above the inkjet printing system of FIG. 3.

Turning now to FIGS. 3 and 4, an embodiment of a printing system 300 will be described, which may be used as the printing system 100 described above with reference to FIG. 2. FIG. 3 comprises a schematic illustrating a portion of the printing system 300 from a side view. FIG. 4 comprises a plan view of a portion of the printing system 300 from above the media transport assembly 303. In FIG. 4, some components that would be hidden from view are illustrated in dashed lines.

As illustrated in FIGS. 3 and 4, the printing system 300 comprises an ink deposition assembly 301 and a media transport assembly 303, which can be used as the ink deposition assembly 101 and media transport assembly 103, respectively, described above with reference to FIG. 2. The printing system 300 may also comprise additional components not illustrated in FIGS. 3 and 4, such as a control system (e.g., similar to the control system 135).

In the printing system 300, the ink deposition assembly 301 comprises four printhead modules 302 as shown in FIG. 3, with each printhead module 302 having multiple printhead 310. The printhead models 302 are arranged in series along a process direction P above the media transport assembly 303, such that the print media 305 is transported sequentially beneath each of the printhead modules 302. In FIG. 4, just one of the printhead modules 302 is visible. The printheads 310 are arranged to eject print fluid (e.g., ink) through respectively corresponding printhead openings 319 in a corresponding carrier plate 311. In an embodiment (see FIG. 4), each printhead module 302 has three printheads 310 and the printheads 310 are arranged in an offset pattern with two printheads 310_1 and 310_2 being aligned within one another in the cross-process direction and the third printhead 310_3 being offset upstream or downstream from the other two printheads 310_1 and 310_2. In other embodiments, different numbers and/or arrangements of printheads 310 and/or printhead modules 302 are used.

In the printing system 300, the movable support surface 320 of the media transport assembly 303 comprises a flexible belt driven by rollers 329 to move along a looped path, with a portion of the path passing through the ink deposition region 323 of the ink deposition assembly 301. Additional rollers other than those illustrated may also be provided, such as one or more rollers to press the print media against the movable support surface 320 when being loaded onto the movable support surface 320, one or more rollers to engage an outward facing surface of the movable support surface 320, and so on as would be familiar to those of ordinary skill in the art. The path that the movable support surface 320 takes in FIG. 3 is non-limiting and other paths may be utilized. The media transport assembly 303 also comprises a media loading/registration device 355, which loads print media 305 onto the movable support surface 320 and registers the print media 305 relative to the movable support surface 320. The media loading/registration device 355 is similar to and may be used as the media loading/registration device 155 described above.

The movable support surface 320 comprises a number of holes 321 extending through the belt. The holes 321 are to communicate vacuum suction from below the belt (from the vacuum plenum 326, described further below) to the region above the belt to provide a vacuum suction force to hold the print media against the movable support surface 320. The holes 321 are arranged in a pattern across the movable support surface 320 so as to provide relatively even vacuum suction force to the print media and so as to accommodate various sizes of print media.

The vacuum plenum 325 comprises a vacuum platen 326, which forms a top wall of the plenum 325 and supports the movable support surface 320. The vacuum platen 326 may be used as the vacuum platen 126 described above. The vacuum platen 326 comprises a number of platen holes 327 distributed across the platen 326, which fluidically couple the interior of the vacuum plenum 325 to the region above the platen 326. Although the platen holes 327 can be through-holes with a relatively simple shape, such as cylindrical through-holes, the platen holes 327 are not limited to such simple through-holes and can have any shape or configuration that provides a passageway to communicate the vacuum suction from the vacuum plenum 325 to the region above the platen 326. The platen holes 327 are fluidically coupled to openings in the first surface (e.g., top surface) of the vacuum platen 326, which can be openings of the platen holes 327 themselves or the openings of channels or other features of the vacuum platen 326 to which the platen holes 327 are fluidically coupled. For example, in some embodiments (including the embodiments illustrated in FIGS. 3-8), the platen holes 327 are configured as through-holes which are coupled at one end to the interior of the vacuum platen 325 via outlet openings in a second surface (e.g., bottom surface) of the vacuum platen 326 and inlet openings and coupled at the opposite end to an open platen channel 330 that is formed in the first surface (e.g., top surface) of the vacuum platen 327, as seen in the expanded cutaway of FIG. 3 and the dashed lines in FIG. 4. The platen channels 330 may be elongated in the process direction. In some embodiments, multiple platen holes 327 are fluidically coupled to the same platen channel 330. The platen holes 327 and channels 330 are arranged in columns extending the process direction (y-direction in the figures), and the columns are distributed across the platen 326 in the cross-process direction (x-direction in the figures). Each of the holes 321 in the movable support surface 320 aligns with a column of the platen holes 327/channels 330 such that each hole 321 sequentially moves over each of the platen holes 327/channels 330 in the column as the movable supports surface moves 320 relative to the platen 326. When a given hole 321 is located above a given platen hole 327/channel 330, the vacuum suction is communicated from the vacuum plenum 325 to the region above the movable support surface 320 via the platen hole 327/channel 330 and the movable support surface hole 321.

The vacuum platen 326 also comprises at least one high impedance zone 331 and at least one low impedance zone 333. In some embodiments, the vacuum platen 326 comprises a plurality of high impedances zones 331. The high and low impedance zones 331, 333 are similar to, and may be used as, the high and low impedance zones 131, 133, respectively, which were described above. In the printing system 300, the high impedance zones 331 are provided on a per-printhead basis, i.e., each printhead 310 has a corresponding high impedance zone 331. For example, as shown in FIG. 4, a first printhead 310_1 has a corresponding high impedance zone 331_1, a second printhead 310_2 has a corresponding high impedance zone 331_2, and a third printhead 310_3 has a corresponding high impedance zone 331_3. Moreover, in the printing system 300, each high impedance zone 331 includes at least all of the platen holes 327 that are located directly under the corresponding printhead 310. In some embodiments, each high impedance zone 331 includes at least all of the platen holes 327 that are coupled to a channel 330 that is located directly under the corresponding printhead 310. In an embodiment, each high impedance zone 331 can also include some additional platen holes 327 (and/or channels 330) that are located adjacent to (e.g., immediately upstream or downstream of) the corresponding printhead 310. By providing high impedance zones 331 at least for each printhead 310, when the intermedia zone 322 is under the printhead 310, the high impedance zone 331 reduces the rate of airflow through the uncovered platen holes 327 that are under or adjacent to the printhead 310, thus reducing the strength of crossflows.

As shown in FIG. 3, a low impedance zone 333 is provided at an upstream side of the vacuum platen 326 in a region where print media are first loaded onto the movable support surface 320. Thus, high suction can be maintained in this region to facilitate adhering the print media to the movable support surface 320. Note that, although only one low impedance zone 333 is labeled in FIGS. 3 and 4, each portion of the vacuum platen 326 that is not part of one of the high impedance zones 331 is de facto part of a low impedance zone. Thus, in some embodiments of the printing system 300, in addition to the labeled low impedance zone 333 that is located in the loading region, low impedance zones can also be located between adjacent printhead modules 302 and under each printhead module 302 in regions that are not located under or adjacent to a printhead 310. These low impedance zones can help to ensure sufficient hold down force is provided (or restore the hold down force if reduced) for the print media when they are passing through the deposition region, and because these low impedance zones are relatively distant from the ink deposition regions of the printheads 310, the relatively higher suction rate through these low impedance zones does not contribute much to the strength of crossflows. In some embodiments, the airflow impedances of the low impedance zones are not necessarily all the same as one another—for example, in some embodiments the low impedance zone 333 may have a relatively lower airflow impedance than even the other low impedance zones, which in turn each have a relatively lower airflow impedance than the high impedance zones 331.

In some embodiments (not illustrated), high impedance zones 331 may be provided per printhead module 302, instead of per-printhead 310. In some embodiments, a single high impedance zone 331 is provided for all of the deposition region 323 (i.e., for all of the printhead modules 302), rather than per-printhead 310 or per-printhead module 302.

Figure 5:
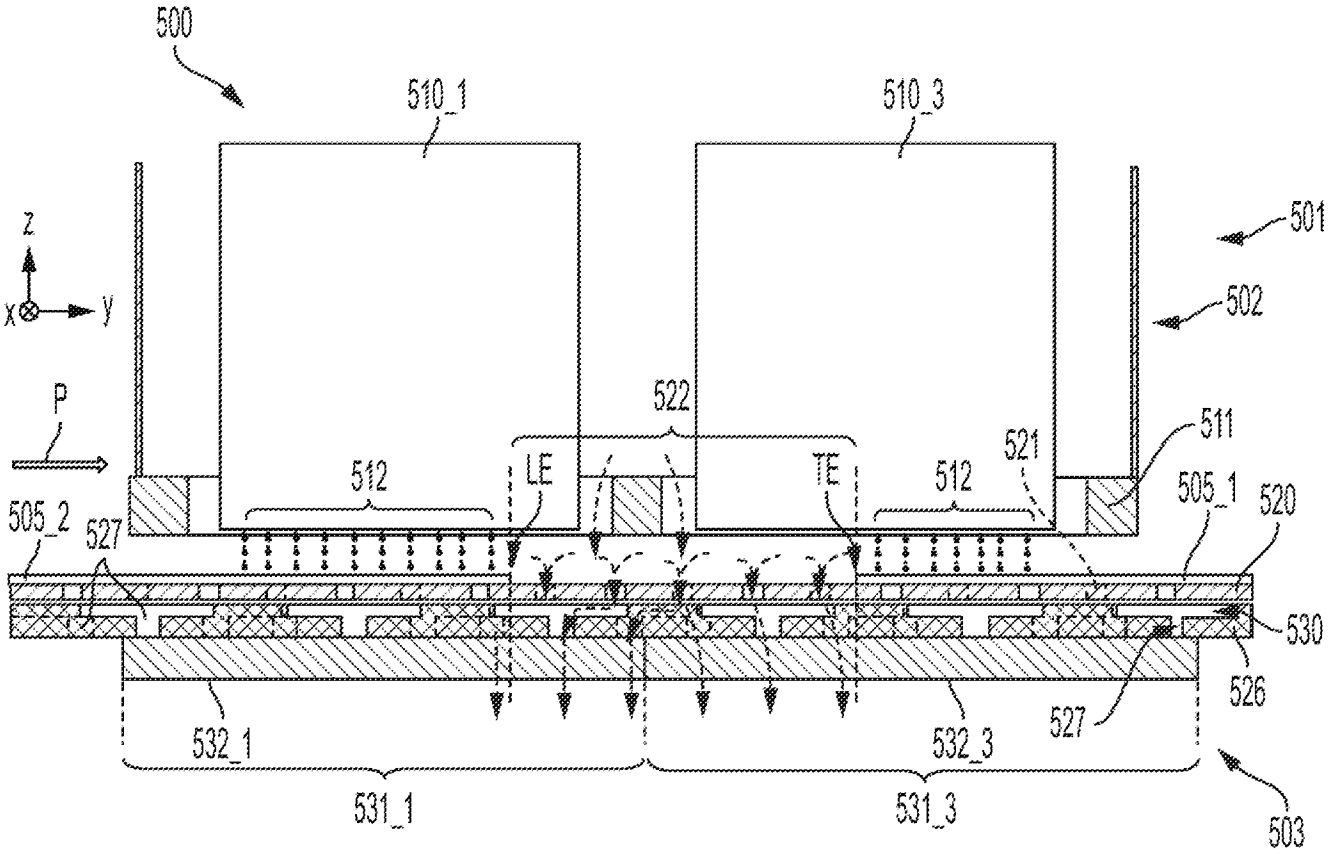
FIG. 5 is a cross-sectional view of an embodiment of an inkjet printing system, with the cross-section taken along D in FIG. 4.
Figure 6:
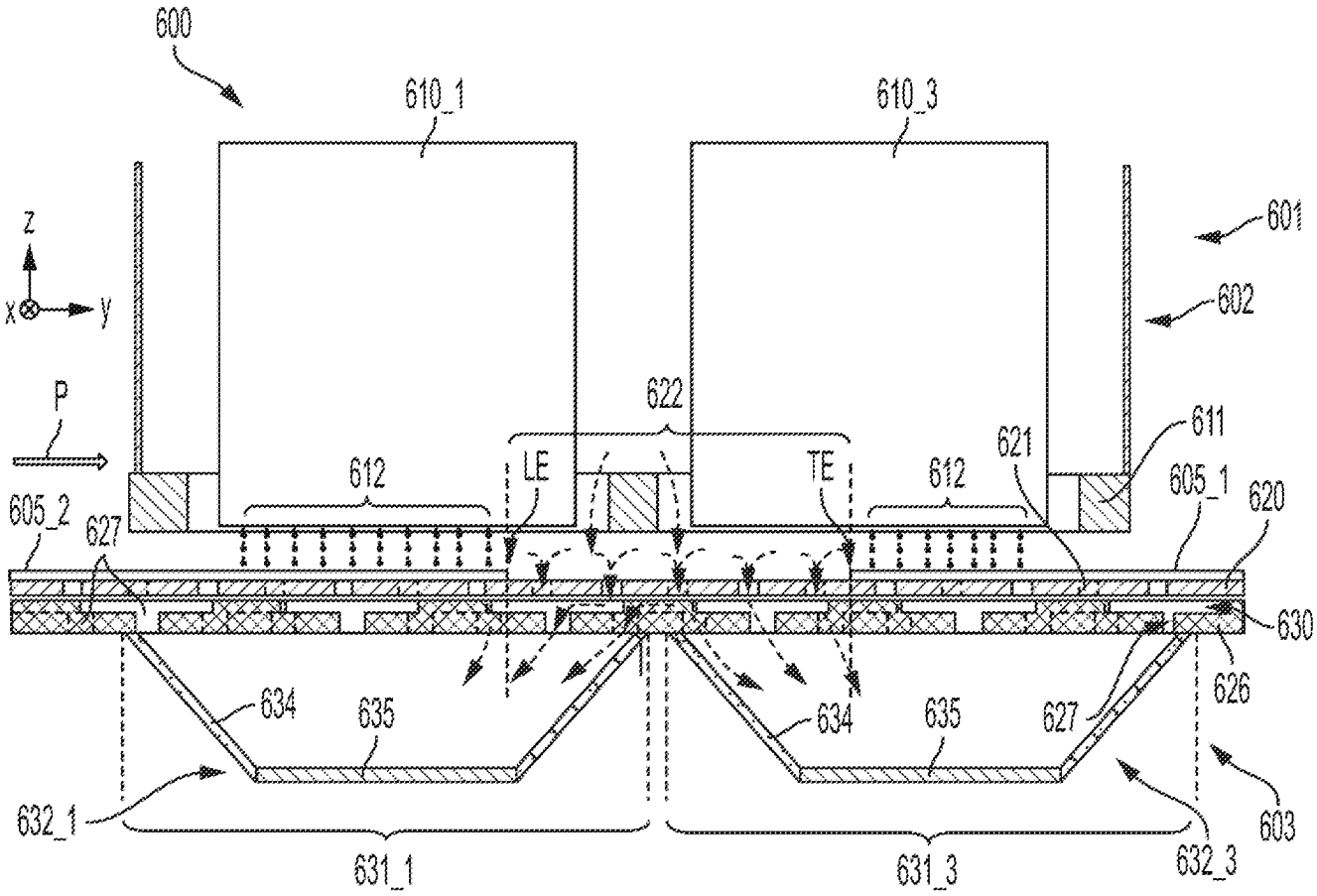
FIG. 6 is a cross-sectional view of another embodiment of an inkjet printing system, with the cross-section taken along D in FIG. 4.
Figure 7:
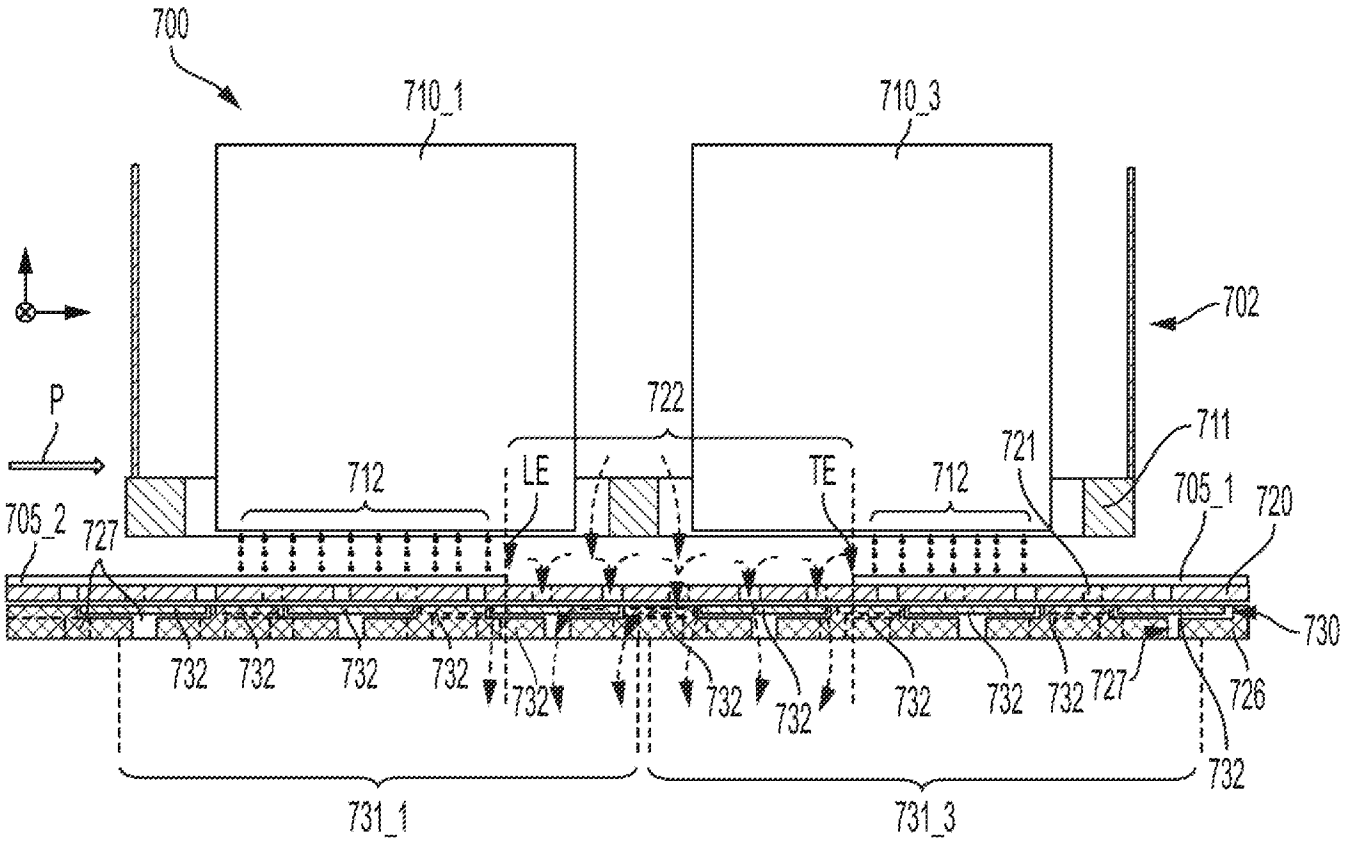
FIG. 7 is a cross-sectional view of yet another embodiment of an inkjet printing system, with the cross-section taken along D in FIG. 4.

The printing system 300 utilizes a platen 326 with high impedance zones 331 established by including an airflow restriction mechanism to restrict the collective airflow through vacuum platen 326 via the group of platen holes 327 located in the high impedance zone. As shown in FIGS. 3 and 4, in embodiments of the printing system 300, an airflow restriction mechanism is used which comprises airflow impeding structures 332. Various embodiments of airflow impeding structures, which can be used as the airflow impeding structures 332, are described below with respect to FIGS. 5-7. FIGS. 5-7 illustrate some embodiments of printing systems, which can be used as the printing system 300, with each having a different embodiment of an airflow impeding structure.

Figure 8:
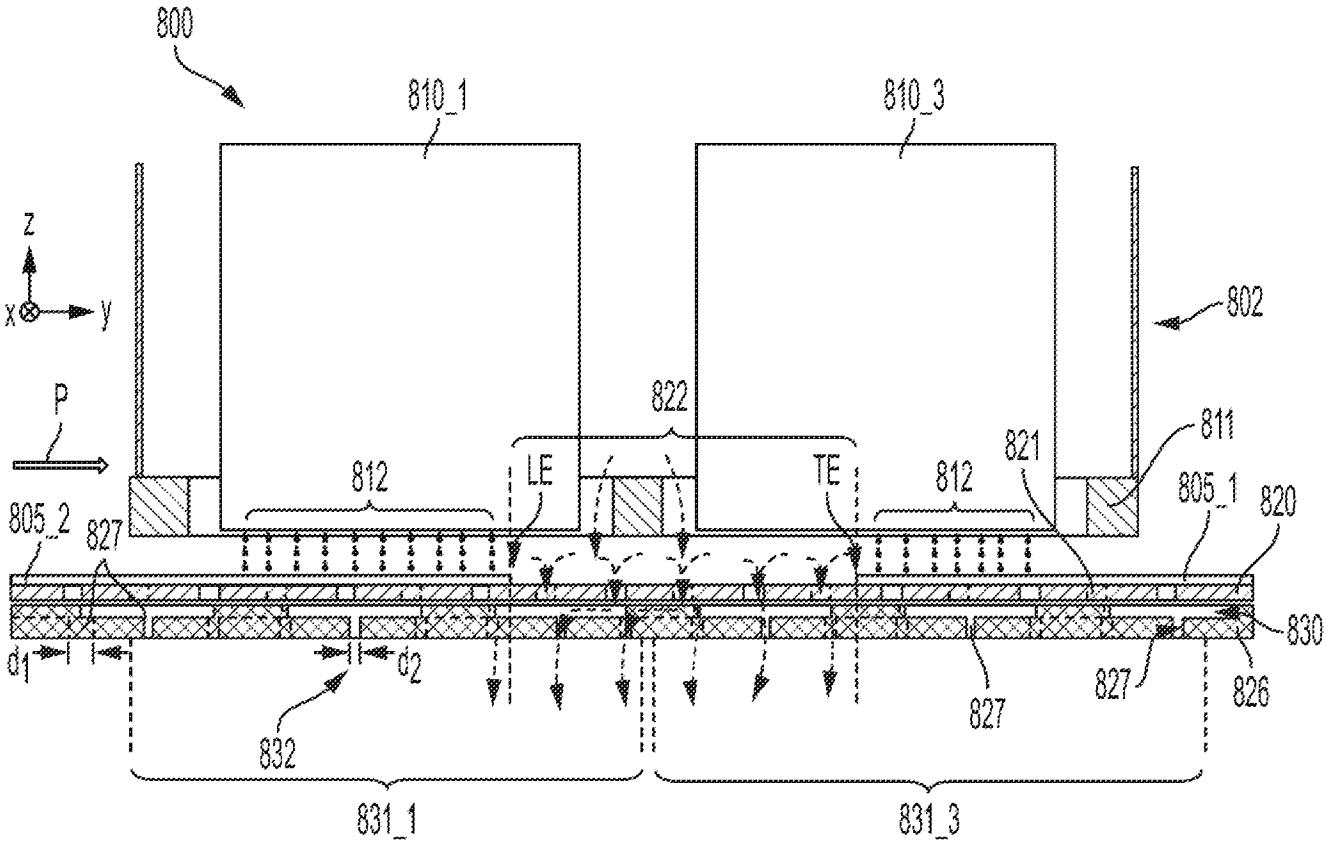
FIG. 8 is a cross-sectional view of a further embodiment of an inkjet printing system, with the cross-section taken along D in FIG. 4.

In some embodiments of a printing system, which are similar to the printing system 300, the airflow restriction mechanism does not comprise an airflow impeding structure and instead comprises the configuration (e.g., size, shape, density etc.) of the platen holes themselves, as described above. FIG. 8 which is described further below, illustrates another embodiment of a printing system, which is similar to printing system 300 with the exception that the airflow restriction mechanism in the high impedance zones is established by the configuration of the platen holes (cross-sectional area, and/or density) compared to the configuration of platen holes in a low impedance zone.

Turning now to FIG. 5, an embodiment of the printing system 500 will be described. The printing system 500 can be used as the printing systems 300 and 100 described above. The printing system 500 comprises a printing assembly 501 and a media transport assembly 503, which can be used as the printing assembly 301 or 101 and media transport assembly 303 or 301, respectively. The media transport assembly 503 comprises a number of a printhead modules 502, each with printheads 510 and a carrier plate 511, similar to the printhead modules 302. The media transport assembly 503 comprises a vacuum platen 527 with platen holes 527, similar to the vacuum platen 327, and a movable support surface 520 with holes 521, similar to the movable support surface 320. In FIG. 5, the platen holes 527 are through-hole which are coupled to channels 530, as described above. However, in other embodiments differently shaped platen holes 527 may be used. In FIG. 5, some platen holes 527 that would be hidden in the view because they do not fall along the line upon which the cross-section is take (i.e., D in FIG. 4) are shown in dashed lines.

The printing system 500 also comprises a plurality of high impedance zones 531 (e.g., 531_1 and 531_3), which may be used as the high impedance zones 331 and 131. The high impedance zones 531 may be provided for each printhead 510 in a similar manner as the high impedance zones 331 illustrated in FIG. 4. Thus, a high impedance zone 531_1 is provided for the printhead 510_1 and a high impedance zone 531_3 is provided for the printhead 510_3 (an additional high impedance zones 531 may be provided for other printheads 510, which are not visible in FIG. 5, such as the printhead 310_2 in FIG. 4). In the printing system 500, each high impedance zone 531 comprise an airflow restriction mechanism comprising an airflow impeding structure 532 that is positioned against a bottom side of the vacuum platen 526 so as to cover the bottom opening (outlet side of vacuum air flow to the vacuum source) of each hole 527 that is located in the respective high impedance zone 531. Thus, air flowing between any of the holes 527 in a given high impedance zone 531 and the interior of a vacuum plenum passes through the corresponding airflow impeding structure 532. Any flow impeding structure may be used as the airflow impeding structure 532, including the structures described above with respect to the airflow impeding structure 332 and 132. For example, the airflow impeding structure 532 may comprise a porous material (e.g., sponge, filter, etc.), mesh, fabric, or fiber array (e.g., brush, steel wool).

As described above, providing the high impedance zones 531 at least near the printhead 510 can reduce the strength of crossflows and thus reduce the amount of image blur that occurs near the lead edge and trail edge of the print media. For example, FIG. 5 illustrates a state in which a lead edge LE of a print medium 505_2 is located under the printhead 510_1, which is similar to the state illustrated in FIG. 1D. In such a state, air will be pulled down through uncovered holes 521 and holes 527 in the inter-media zone 522, as indicated by the dash-lined arrows in FIG. 5. Due to the proximity of these uncovered holes 521 and 527 to the ink deposition region 512 of the printhead 510_1, some of these airflows that are sucked through these holes 521 and 526 will include crossflows that pass through the deposition region 512 and thus produce image blur near the lead edge LE, as explained above with respect to the similar state illustrated in FIG. 1D. However, because the airflow impeding structure 532_1 is present, the rate of airflow through the uncovered holes 521 and 527 in this state is significantly reduced as compared to the state illustrated in FIG. 1D in which such structures are absent. Because the flow rate of the airflow through the uncovered holes 521 and 527 is reduced, the strength of the crossflows is reduced and hence the amount of image blur near the lead edge LE is reduced.

FIG. 5 also illustrates a state in which the trail edge TE of the print media 505_1 is located under the printhead 510_3, which is similar to the state illustrated in FIG. 1A. In such a state, due to the proximity of the inter-media zone to the ink deposition region 512 of the printhead 510_3, the uncovered holes 521 and 527 in the inter-media zone 522 will induce airflow which will include some crossflows that flow through the ink deposition region 512 of the printhead 510_3. These crossflows will produce image blur near the trail edge TE, as described above with respect to FIG. 1A. However, because the airflow impeding structure 532_3 is present, the flow rate of these airflows is significantly reduced as compared to the state illustrated in FIG. 1A, and therefore the strength of the crossflows and the amount of image blur near the trail edge TE are reduced.

Turning now to FIG. 6, another embodiment of a printing system 600 will be described. The printing system 600 can be used as the printing systems 300 and 100 described above. The printing system 600 comprises a printing assembly 601 and a media transport assembly 603, which can be used as the printing assembly 301 or 101 and media transport assembly 303 or 301, respectively. The media transport assembly 603 comprises a number of a printhead modules 602, each with printheads 610 and a carrier plate 611, similar to the printhead modules 302. The media transport assembly 603 comprises a vacuum platen 627 with platen holes 627, similar to the vacuum platen 327, and a movable support surface 620 with holes 621, similar to the movable support surface 320. In FIG. 6, the platen holes 627 are through-holes coupled to platen channels 630, as described above. However, in other embodiments differently shaped platen holes 627 may be used. In FIG. 6, some platen holes 627 that would be hidden in the view because they do not fall along the line upon which the cross-section is take (e.g., D in FIG. 4) are shown in dashed lines.

The printing system 600 also comprises a plurality of high impedance zones 631 (e.g., 631_1 and 631_3), which may be used as the high impedance zones 331 and 131. The high impedance zones 631 may be provided for each printhead 610 in a similar manner as the high impedance zones 331 illustrated in FIG. 4. Thus, a high impedance zone 631_1 is provided for the printhead 610_1 and a high impedance zone 631_3 is provided for the printhead 610_3 (additional high impedance zones 631 may be provided for other printheads 610 which are not visible in FIG. 6, such as the printhead 332_2 in FIG. 4). In the printing system 600, the high impedance zones 631 comprise airflow impeding structures 632 (e.g., airflow impeding structures 632_1 and 632_2). Each airflow impeding structure 632 comprises baffles 634 that form a passageway with a first opening at one end that is positioned against a bottom side of the vacuum platen 626 and which encompasses the bottom openings of the platen holes 627 located in the respective high impedance zone 631, and a second opening that opens into the interior of the vacuum plenum. Thus, the collective airflow that flows from above the platen 626 to the vacuum plenum via the high impedance zone 631 passes through the passageway defined by the baffles 634. The airflow impeding structure 632 also comprises a flow impeding portion 635 which has one or more apertures to allow impeded airflow to pass between the vacuum plenum and the interior of the passageway. In this context, allowing impeded airflow to flow refers to not preventing airflow entirely, but restricting, inhibited, or otherwise impeding the airflow such that a flow rate of the airflow is lower than it otherwise would have been without the restriction. For example, the flow impeding portion 635 may comprise a section of baffle 634 that has perforations or other apertures. As another example, the flow impeding portion 635 may comprise a filter, a mesh, a porous material, a fabric, an array of fibers (e.g., a brush), or any other structure that allows but inhibits airflow. One advantage of this embodiment is the compact size of the flow impeding portion 635 compared to the size of the high impedance zone 631 as a whole—a relatively small flow impeding portion 635 can be used to control airflow through a relatively larger region of the platen 626.

The high impedance zones 631 reduce the amount of image blur that occurs near the lead edge LE and trail edge TE of the print media. For example, FIG. 6 illustrates a state in which a lead edge LE of a print medium 605_2 is located under the printhead 610_1, which is similar to the state illustrated in FIG. 1D. In such a state, air will be pulled down through uncovered holes 621 and holes 627 in the inter-media zone 622, as indicated by the dash-lined arrows in FIG. 6. Due to the proximity of these uncovered holes 621 and 627 to the ink deposition region 612 of the printhead 610_1, some of these airflows that are sucked through these holes 621 and 626 will include crossflows that pass through the deposition region 612 and thus produce image blur near the lead edge LE, as explained above with respect to the similar state illustrated in FIG. 1D. However, because the airflow impeding structure 632_1 is present, the rate of airflow through the uncovered holes 621 and 627 in this state is significantly reduced as compared to the state illustrated in FIG. 1D in which such structures are absent. Because the flow rate of the airflow through the uncovered holes 621 and 627 is reduced, the strength of the crossflows is reduced and hence the amount of image blur near the lead edge LE is reduced.

FIG. 6 also illustrates a state in which the trail edge TE of the print media 605_1 is located under the printhead 610_3, which is similar to the state illustrated in FIG. 1A. In such a state, due to the proximity of the inter-media zone to the ink deposition region 612 of the printhead 610_3, the uncovered holes 621 and 627 in the inter-media zone 622 will induce airflow which will include some crossflows that flow through the ink deposition region 612 of the printhead 610_3. These crossflows will produce image blur near the trail edge TE, as described above with respect to FIG. 1A. However, because the airflow impeding structure 632_3 is present, the flow rate of these airflows is significantly reduced as compared to the state illustrated in FIG. 1A, and therefore the strength of the crossflows and the amount of image blur near the trail edge TE are reduced.

Turning now to FIG. 7, yet another embodiment of a printing system 700 will be described. The printing system 700 can be used as the printing systems 300 and 100 described above. The printing system 700 comprises a printing assembly 701 and a media transport assembly 703, which can be used as the printing assembly 301 or 101 and media transport assembly 303 or 301, respectively. The media transport assembly 703 comprises a number of a printhead modules 702, each with printheads 710 and a carrier plate 711, similar to the printhead modules 302. The media transport assembly 703 comprises a vacuum platen 727 with platen holes 727, similar to the vacuum platen 327, and a movable support surface 720 with holes 721, similar to the movable support surface 320. In FIG. 7, the platen holes 727 are through-hole portions coupled to platen channel 730, as described above. However, in other embodiments differently shaped platen holes 727 may be used. In FIG. 7, some platen holes 727 that would be hidden in the view because they do not fall along the line upon which the cross-section is take (e.g., D in FIG. 4) are shown in dashed lines.

The printing system 700 comprises a plurality of high impedance zones 731 (e.g., 731_1 and 731_3), which may be used as the high impedance zones 331 and 131. The high impedance zones 731 may be provided for each printhead 710 in a similar manner as the high impedance zones 331 illustrated in FIG. 4. Thus, a high impedance zone 731_1 is provided for the printhead 710_1 and a high impedance zone 731_3 is provided for the printhead 710_3 (additional high impedance zones 731 may be provided for other printheads 710 which are not visible in FIG. 7). In the printing system 700, each high impedance zone 731 comprises a plurality of airflow impeding structures 732, i.e., one airflow impeding structure 732 for each platen holes 327 and/or platen channel 330 that is located in the respective high impedance zone 731. In FIG. 7 the airflow impeding structures 732 are illustrated as being positioned in the platen channels 330, but in other embodiments the airflow impeding structures 732 could be positioned within the platen holes 727 or both in the platen holes 727 and in the channels 730. Thus, each airflow impeding structure 732 increases the impedance of an individual platen holes 727 and/or channel 730, and this results in an increase in the collective airflow impedance of the high impedance zone 731. The airflow impeding structure 732 may comprise a porous material (e.g., sponge), fins, a pin array, a pin-fin array, an array of fibers (e.g., a brush), a filter, a mesh, a fabric, or any other structure that allows but inhibits airflow and can be positioned within the platen holes 727. This embodiment can potentially improve the uniformity of the regulated suction flow and suction pressure. Moreover, in some embodiments, because airflow impeding structure 732 are provided per-platen hole 727 and/or channel, the impedances can be fine-tuned or optimized on a per-platen hole 727 and/or per-channel 730 basis (e.g., by providing airflow impeding structure 732 having differing impedances in different platen holes 727 and/or channel 730). In some embodiments, the airflow impeding structures 732 may be accessible from a top side of the vacuum platen 726 (upon removal of the movable support surface), which may make it easier to clean, repair, remove, and/or replace the airflow impeding structures 732 as needed (e.g., as they get contaminated, clogged, or damaged).

The high impedance zones 731 reduce the amount of image blur that occurs near the lead edge LE and trail edge TE of the print media. For example, FIG. 7 illustrates a state in which a lead edge LE of a print medium 705_2 is located under the printhead 710_1, which is similar to the state illustrated in FIG. 1D. In such a state, air will be pulled down through uncovered holes 721 and holes 727 in the inter-media zone 722, as indicated by the dash-lined arrows in FIG. 7. Due to the proximity of these uncovered holes 721 and 727 to the ink deposition region 712 of the printhead 710_1, some of these airflows that are sucked through these holes 721 and 726 will include crossflows that pass through the deposition region 712 and thus produce image blur near the lead edge LE, as explained above with respect to the similar state illustrated in FIG. 1D. However, because the airflow impeding structures 732 are present, the rate of airflow through the uncovered holes 721 and 727 in this state is significantly reduced as compared to the state illustrated in FIG. 1D in which such structures are absent. Because the flow rate of the airflow through the uncovered holes 721 and 727 is reduced, the strength of the crossflows is reduced and hence the amount of image blur near the lead edge LE is reduced.

FIG. 7 also illustrates a state in which the trail edge TE of the print media 705_1 is located under the printhead 710_3, which is similar to the state illustrated in FIG. 1A. In such a state, due to the proximity of the inter-media zone to the ink deposition region 712 of the printhead 710_3, the uncovered holes 721 and 727 in the inter-media zone 722 will induce airflow which will include some crossflows that flow through the ink deposition region 712 of the printhead 710_3. These crossflows will produce image blur near the trail edge TE, as described above with respect to FIG. 1A. However, because the airflow impeding structures 732 are present, the flow rate of these airflows is significantly reduced as compared to the state illustrated in FIG. 1A, and therefore the strength of the crossflows and the amount of image blur near the trail edge TE are reduced.

Turning now to FIG. 8, another embodiment of a printing system 800 will be described. The printing system 800 can be used as the printing systems 300 and 100 described above. The printing system 800 comprises a printing assembly 801 and a media transport assembly 803, which can be used as the printing assembly 301 or 101 and media transport assembly 303 or 301, respectively. The media transport assembly 803 comprises a number of a printhead modules 802, each with printheads 810 and a carrier plate 811, similar to the printhead modules 302. The media transport assembly 803 comprises a vacuum platen 827 with platen holes 827, similar to the vacuum platen 327, and a movable support surface 820 with holes 821, similar to the movable support surface 320. In FIG. 8, the platen holes 827 are through-holes coupled to platen channel 830, as described above. However, in other embodiments differently shaped platen holes 827 may be used. In FIG. 8, some platen holes 827 that would be hidden in the view because they do not fall along the line upon which the cross-section is take (e.g., D in FIG. 4) are shown in dashed lines.

The printing system 800 comprises a plurality of high impedance zones 831 (e.g., 831_1 and 831_3), which may be used as the high impedance zones 331 and 131. The high impedance zones 831 may be provided for each printhead 810 in a similar manner as the high impedance zones 331 illustrated in FIG. 4. Thus, a high impedance zone 831_1 is provided for the printhead 810_1 and a high impedance zone 831_3 is provided for the printhead 810_3 (additional high impedance zones 831 may be provided for other printheads 810 which are not visible in FIG. 8). In contrast to the printing systems 500, 600, and 700, in the printing system 800 the high impedance zones 831 do not comprise airflow impeding structures 832. Instead, in the printing system 800 the high impedance zones 831 are established by an airflow restriction mechanism comprising differing configurations of the platen holes 827 in the high impedance zone 831 as compared to the platen holes 827 elsewhere in the vacuum platen 826. For example, in FIG. 8 the platen holes 827 that are located in a high impedance zone 831 have a smaller cross-sectional area than the platen holes 827 located in a low impedance zone, i.e., a diameter $d_2$ of the platen holes 827 in the high impedance zone 831 is smaller than a diameter $d_1$ of the platen holes 827 in the low impedance zone. The smaller cross-sectional area of the platen holes 827 in the high impedance zone 831 results in greater airflow impedance through the platen holes 827. In other embodiments, the increased impedance can be provided through changing other aspects of the platen holes 827 in the high impedance zone 831, such as by reducing the number of holes 827 over a unit area (referred to herein as the "hole density") in the high impedance zone 831. In some embodiments, multiple aspects of the platen holes 827 in the high impedance zones 831 are altered, such as decreasing both their diameter and their density. An advantage of this embodiment is that the airflow restriction mechanisms are built into the plenum construction, which can make overall manufacture and maintenance simpler than having separate parts provide the airflow restriction mechanisms.

The inclusion of the high impedance zones 831 in the platen 826 reduces the amount of image blur that occurs near the lead edge LE and trail edge TE of the print media. For example, FIG. 8 illustrates a state in which a lead edge LE of a print medium 805_2 is located under the printhead

810_1, which is similar to the state illustrated in FIG. 1D. In such a state, air will be pulled down through uncovered holes 821 and holes 827 in the inter-media zone 822, as indicated by the dash-lined arrows in FIG. 8. Due to the proximity of these uncovered holes 821 and 827 to the ink deposition region 812 of the printhead 810_1, some of these airflows that are sucked through these holes 821 and 826 will include crossflows that pass through the deposition region 812 and thus produce image blur near the lead edge LE, as explained above with respect to the similar state illustrated in FIG. 1D. However, because the platen holes 827 near the printhead 810 have higher impedance, the rate of airflow through the uncovered holes 821 and 827 in this state is significantly reduced as compared to the state illustrated in FIG. 1D in which all of the platen holes have similar impedance. Because the flow rate of the airflow through the uncovered holes 821 and 827 is reduced, the strength of the crossflows is reduced and hence the amount of image blur near the lead edge LE is reduced.

FIG. 8 also illustrates a state in which the trail edge TE of the print media 805_1 is located under the printhead 810_3, which is similar to the state illustrated in FIG. 1A. In such a state, due to the proximity of the inter-media zone to the ink deposition region 812 of the printhead 810_3, the uncovered holes 821 and 827 in the inter-media zone 822 will induce airflow which will include some crossflows that flow through the ink deposition region 812 of the printhead 810_3. These crossflows will produce image blur near the trail edge TE, as described above with respect to FIG. 1A. However, because the platen holes 827 have higher impedance, the flow rate of these airflows is significantly reduced as compared to the state illustrated in FIG. 1A, and therefore the strength of the crossflows and the amount of image blur near the trail edge TE are reduced.

FIGS. 5-8 illustrate various embodiments of printing systems comprising airflow restriction mechanisms that establish high impedance zones in a vacuum platen. These embodiments are not limiting. In particular, any flow impeding structure and/or any configuration of platen holes may be used to increase the impedance through one zone of the vacuum platen as compared to another zone of the vacuum platen. For example, any of the approaches described above could be combined with any of the other approaches described above, with or without modification. In particular, flow impeding structures can be used in combination with changing the configuration of the platen holes. Furthermore, although specific configurations of various components are illustrated in the figures and described in detail above to provide context and aid understanding, it should be understood that embodiments disclosed herein encompass a variety of printing systems having components that can be configured differently than the illustrated examples, such as differently configured printhead modules, printheads, vacuum plenums, vacuum platens, platen holes, and/or movable support surfaces. In particular, the techniques disclosed herein related to providing high impedance zones (e.g., near printheads) and low impedance zones (e.g., near a print media loading region) can be used in a variety of printing systems regardless of the specific configurations of the printhead modules, printheads, vacuum plenums, vacuum platens, platen holes, and/or movable support surfaces.

As noted above, in various embodiments the airflow restriction mechanism comprises a plurality of airflow impeding structures that are disposed within the individual platen holes or platen channels that are located in a high impedance zone. Embodiments of printing systems comprising various embodiments such airflow impeding structures are described in greater detail below with respect to FIGS. 9A-12B. These airflow impeding structures may be used, for example, to form the high impedance zones 131 in embodiments of the printing system 100 and/or as the airflow impeding structures 732 described above. The various embodiments of airflow impeding structures described below are merely examples and are non-limiting. One of ordinary skill in the art would understand that other types of flow impeding structures could be disposed within the platen holes and/or platen channels in an similar manner as described below.

Figure 9A:
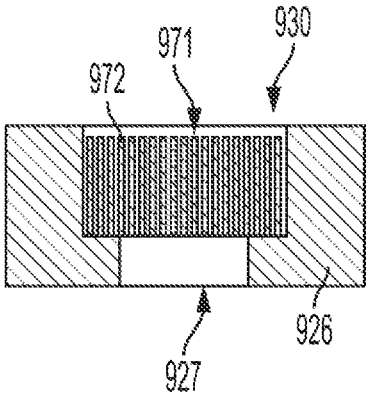
FIGS. 9A and 9B illustrate a further embodiment of an inkjet printing system.
Figure 9B:
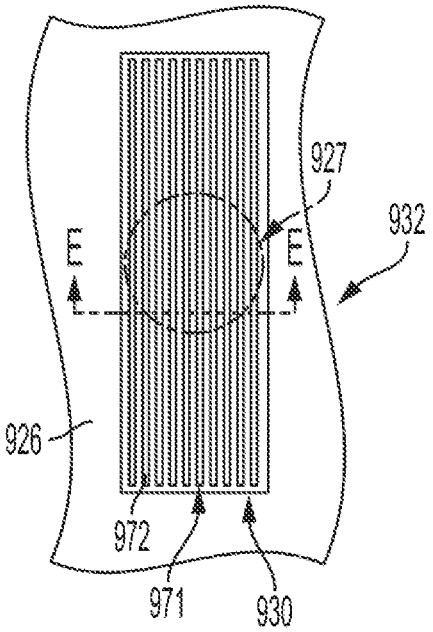

FIGS. 9A and 9B illustrate an embodiment in which the flow impeding structures comprise a fin array 971 disposed within a platen channel 930 in a platen 926. FIG. 9B illustrates a plan view of a portion of the platen 926, and FIG. 9A is a cross-section taken along E in FIG. 9B. The fin array 971 comprises a number fins 972 that extend roughly parallel to a longitudinal dimension of the channel 930, extending over the platen holes 927. The fins 972 comprise relatively thin plate-like structures, which are positioned parallel to one another. The fins 972 may be integrally connected to platen 926 (e.g., skived fins machined into the platen 926), or they may be formed separately from and then later coupled to the platen 926. The dimensions of the fins 972, the spacing between the fins 972, and the number of fins 972 that are provided are not limited.

Figure 10A:
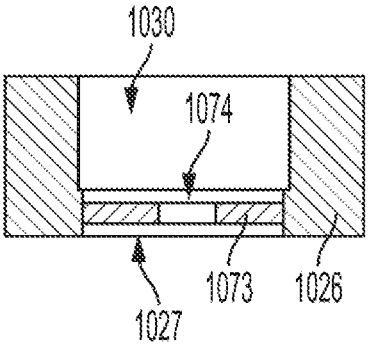
FIGS. 10A and 10B illustrate a further embodiment of an inkjet printing system.
Figure 10B:
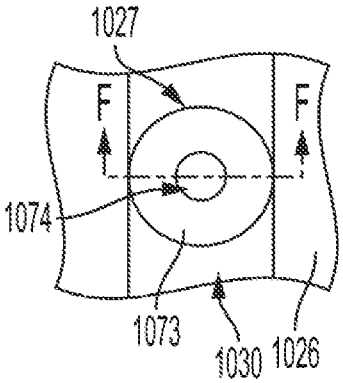

FIGS. 10A and 10B illustrate an embodiment in which the flow impeding structure comprises a wall 1073 with an aperture 1074 disposed within a platen hole 1027. The platen hole 1027 is coupled to a channel 1030 in a platen 1026. FIG. 10B illustrates a plan view of a portion of the platen 1026, and FIG. 10A is a cross-section taken along F in FIG. 10B. Although only one aperture 1074 is illustrated for simplicity, any number of apertures 1074 may be provided. The impedance may be controlled to a desired level by adjusting the number and/or dimensions of the aperture(s) 1074. The aperture(s) 1074 may be any size and shape and may be located anywhere in the wall 1073.

Figure 11A:
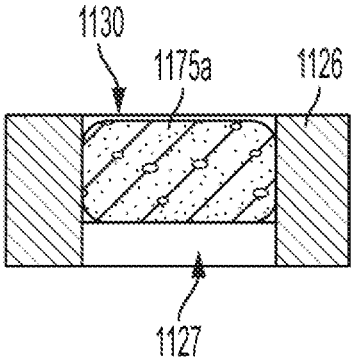
FIGS. 11A-11D illustrate a further embodiment of an inkjet printing system.
Figure 11B:
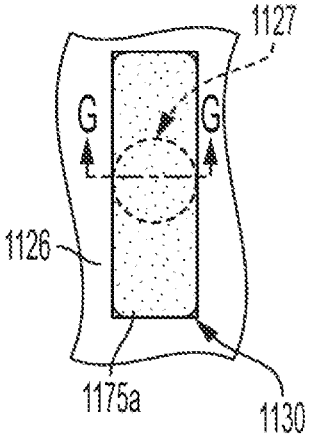
Figure 11C:
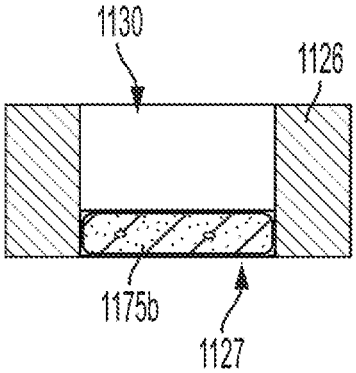
Figure 11D:
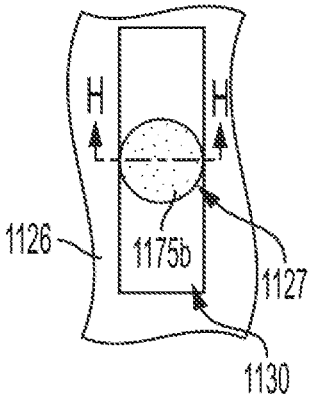

FIGS. 11A-11D illustrate an embodiment in which the flow impeding structure comprises a porous material 1175 (e.g., porous material 1175*a*, 1175*b*), which is disposed within a platen channel 1130 and/or platen hole 1127 in a platen 1126. FIGS. 11B and 11D illustrates plan views of a portion of the platen 1126, and FIGS. 11A and 11C are cross-sections taken along G and H, respectively, in FIGS. 11B and 11D. FIGS. 11A and 11B illustrate a first configuration of the embodiment in which the porous material 1175*a* is disposed within the platen channel 1130. FIGS. 11C and 11D illustrate a second configuration of the embodiment in which the porous material 1175*b* is disposed within the platen hole 1127. The porous material 1175 may comprise any type of porous material, with non-limiting examples including a sponge, a fabric, a filter, foam, steel wool, etc.

Figure 12A:
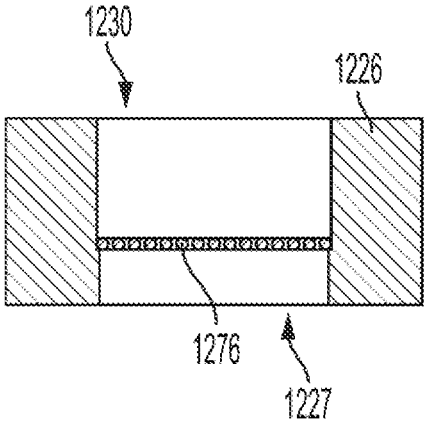
FIGS. 12A and 12B illustrate a further embodiment of an inkjet printing system.
Figure 12B:
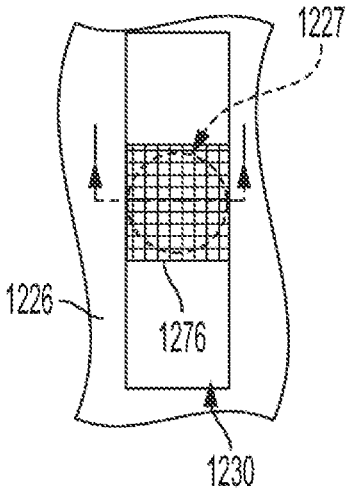

FIGS. 12A and 12B illustrate an embodiment in which the flow impeding structure comprises one or more mesh screens 1278 disposed on, below, or within a platen hole 1227. The platen hole 1227 is coupled to a channel 1230 in a platen 1226. FIG. 12B illustrates a plan view of a portion of the platen 1226, and FIG. 12A is a cross-section taken along I in FIG. 12B. The mesh screen 1278 may comprise any type of mesh, such as a wire mesh, a fiber mesh, etc. The impedance may be controlled to a desired level by changing the size of openings in the mesh screen 1278 and/or by changing a number of mesh screens 1278 that are provided. The dimensions and numbers of the mesh screen 1278 are not limited.

This description and the accompanying drawings that illustrate inventive aspects and embodiments should not be taken as limiting—the claims define the protected invention. Various mechanical, compositional, structural, electrical, and operational changes may be made without departing from the spirit and scope of this description and the claims. In some instances, well-known circuits, structures, and techniques have not been shown or described in detail in order not to obscure the invention. Like numbers in two or more figures represent the same or similar elements.

Further, the terminology used herein to describe aspects of the invention, such as spatial and relational terms, is chosen to aid the reader in understanding embodiments of the invention but is not intended to limit the invention. For example, spatially terms—such as "beneath", "below", "lower", "above", "upper", "inboard", "outboard", "up", "down", and the like—may be used herein to describe directions or one element's or feature's spatial relationship to another element or feature as illustrated in the figures. These spatial terms are used relative to the poses illustrated in the figures, and are not limited to a particular reference frame in the real world. Thus, for example, the direction "up" in the figures does not necessarily have to correspond to an "up" in a world reference frame (e.g., away from the Earth's surface). Furthermore, if a different reference frame is considered than the one illustrated in the figures, then the spatial terms used herein may need to be interpreted differently in that different reference frame. For example, the direction referred to as "up" in relation to one of the figures may correspond to a direction that is called "down" in relation to a different reference frame that is rotated 180 degrees from the figure's reference frame. As another example, if a device is turned over 180 degrees in a world reference frame as compared to how it was illustrated in the figures, then an item described herein as being "above" or "over" a second item in relation to the Figures would be "below" or "beneath" the second item in relation to the world reference frame. Thus, the same spatial relationship or direction can be described using different spatial terms depending on which reference frame is being considered. Moreover, the poses of items illustrated in the figure are chosen for convenience of illustration and description, but in an implementation in practice the items may be posed differently.

The term "process direction" refers to a direction that is parallel to and pointed in the same direction as an axis along which the print media moves as is transported through the deposition region of the ink deposition assembly. Thus, the process direction is a direction parallel to the y-axis in the Figures and pointing in a positive y-axis direction.

The term "cross-process direction" refers to a direction perpendicular to the process direction and parallel to the movable support surface. At any given point, there are two cross-process directions pointing in opposite directions, i.e., an "inboard" cross-process direction and an "outboard" cross-process direction. Thus, considering the reference frames illustrated in the Figures, a cross-process direction is any direction parallel to the x-axis, including directions pointing in a positive or negative direction along the x-axis. References herein to a "cross-process direction" should be understood as referring generally to any of the cross-process directions, rather than to one specific cross-process direction, unless indicated otherwise by the context. Thus, for example, the statement "the valve is movable in a cross-process direction" means that the valve can move in an inboard direction, outboard direction, or both directions.

The terms "upstream" and "downstream" may refer to directions parallel to a process direction, with "downstream" referring to a direction pointing in the same direction as the process direction (i.e., the direction the print media are transported through the ink deposition assembly) and "upstream" referring to a direction pointing opposite the process direction. In the Figures, "upstream" corresponds to a negative y-axis direction, while "downstream" corresponds to a positive y-axis direction. The terms "upstream" and "downstream" may also be used to refer to a relative location of element, with an "upstream" element being displaced in an upstream direction relative to a reference point and a "downstream" element being displaced in a downstream direction relative to a reference point. In other words, an "upstream" element is closer to the beginning of the path the print media takes as it is transported through the ink deposition assembly (e.g., the location where the print media joins the movable support surface) than is some other reference element. Conversely, a "downstream" element is closer to the end of the path (e.g., the location where the print media leaves the support surface) than is some other reference element. The reference point of the other element to which the "upstream" or "downstream" element is compared may be explicitly stated (e.g., "an upstream side of a printhead"), or it may be inferred from the context.

The terms "inboard" and "outboard" refer to cross-process directions, with "inboard" referring to one to cross-process direction and "outboard" referring to a cross-process direction opposite to "inboard." In the Figures, "inboard" corresponds to a positive x-axis direction, while "outboard" corresponds to a negative x-axis direction. The terms "inboard" and "outboard" also refer to relative locations, with an "inboard" element being displaced in an inboard direction relative to a reference point and with an "outboard" element being displaced in an outboard direction relative to a reference point. The reference point may be explicitly stated (e.g., "an inboard side of a printhead"), or it may be inferred from the context.

The term "vertical" refers to a direction perpendicular to the movable support surface in the deposition region. At any given point, there are two vertical directions pointing in opposite directions, i.e., an "upward" direction and an "downward" direction. Thus, considering the reference frames illustrated in the Figures, a vertical direction is any direction parallel to the z-axis, including directions pointing in a positive z-axis direction ("up") or negative z-axis direction ("down").

The term "horizontal" refers to a direction parallel to the movable support surface in the deposition region (or tangent to the movable support surface in the deposition region, if the movable support surface is not flat in the deposition region). Horizontal directions include the process direction and cross-process directions.

The term "vacuum" has various meanings in various contexts, ranging from a strict meaning of a space devoid of all matter to a more generic meaning of a relatively low pressure state. Herein, the term "vacuum" is used in the generic sense, and should be understood as referring broadly to a state or environment in which the air pressure is lower than that of some reference pressure, such as ambient or atmospheric pressure. The amount by which the pressure of the vacuum environment should be lower than that of the reference pressure to be considered a "vacuum" is not limited and may be a small amount or a large amount. Thus, "vacuum" as used herein may include, but is not limited to, states that might be considered a "vacuum" under stricter senses of the term.

The term "air" has various meanings in various contexts, ranging from a strict meaning of the atmosphere of the Earth (or a mixture of gases whose composition is similar to that of the atmosphere of the Earth), to a more generic meaning of any gas or mixture of gases. Herein, the term "air" is used in the generic sense, and should be understood as referring broadly to any gas or mixture of gases. This may include, but is not limited to, the atmosphere of the Earth, an inert gas such as one of the Noble gases (e.g., Helium, Neon, Argon, etc.), Nitrogen ($N_2$) gas, or any other desired gas or mixture of gases.

In addition, the singular forms "a", "an", and "the" are intended to include the plural forms as well, unless the context indicates otherwise. And, the terms "comprises", "comprising", "includes", and the like specify the presence of stated features, steps, operations, elements, and/or components but do not preclude the presence or addition of one or more other features, steps, operations, elements, components, and/or groups. Components described as coupled may be electrically or mechanically directly coupled, or they may be indirectly coupled via one or more intermediate components, unless specifically noted otherwise. Mathematical and geometric terms are not necessarily intended to be used in accordance with their strict definitions unless the context of the description indicates otherwise, because a person having ordinary skill in the art would understand that, for example, a substantially similar element that functions in a substantially similar way could easily fall within the scope of a descriptive term even though the term also has a strict definition.

Elements and their associated aspects that are described in detail with reference to one embodiment may, whenever practical, be included in other embodiments in which they are not specifically shown or described. For example, if an element is described in detail with reference to one embodiment and is not described with reference to a second embodiment, the element may nevertheless be claimed as included in the second embodiment.

It is to be understood that the particular examples and embodiments set forth herein are non-limiting, and modifications to structure, dimensions, materials, and methodologies may be made without departing from the scope of the present teachings.

Other embodiments in accordance with the present disclosure will be apparent to those skilled in the art from consideration of the specification and practice of the inventions disclosed herein. It is intended that the specification and embodiments be considered as exemplary only, with the following claims being entitled to their fullest breadth, including equivalents, under the applicable law.

What is claimed is:

1. A printing system, comprising:

an ink deposition assembly comprising a printhead arranged to eject a print fluid to a deposition region of the ink deposition assembly;

a media transport assembly comprising:

a vacuum source;

a vacuum plenum in fluidic communication with the vacuum source, the vacuum plenum comprising a vacuum platen comprising a plurality of platen holes fluidically coupling an interior of the vacuum plenum to an opening in a first surface of the vacuum platen; and a movable support surface movable over the first surface of the vacuum platen, wherein the media transport assembly is configured hold a print medium against the movable support surface by vacuum suction communicated from the vacuum source through the platen holes to the movable support surface, wherein the vacuum plenum comprises an airflow restriction mechanism comprising one or more airflow impeding structures at one or more fixed positions relative to the vacuum platen and covering a first group of platen holes of the plurality of platen holes throughout transport of the print medium, and wherein the one or more airflow impeding structures cause an airflow impedance through each of the first group of platen holes to be higher than an airflow impedance through a second group of platen holes of the plurality of platen holes.

2. The printing system of claim 1, wherein the one or more airflow impeding structures are positioned at a second surface of the vacuum platen, opposite the first surface of the vacuum platen, covering airflow outlet openings of each platen hole of the first group of platen holes while allowing some airflow through the covered platen holes.

3. The printing system of claim 2, wherein the airflow impeding structure comprises any of a porous material, a mesh, a fabric, a fiber array, or any combination thereof.

4. The printing system of claim 1, wherein the vacuum platen comprises a plurality of platen channels each having an opening corresponding to one of the openings in the first surface, each of the platen holes being fluidically coupled to one of a plurality of platen channels, the plurality of platen channels comprising a first group of platen channels that are fluidically coupled to the first group of platen holes; and wherein the one or more airflow impeding structures comprises a plurality of the airflow impeding structures, each of the airflow impeding structures being positioned within one of first group of platen channels.

5. The printing system of claim 4, wherein each of the airflow impeding structures comprises any of a porous material, a mesh, a fabric, a fiber array, a fin array, a pin array, a baffle, or any combination thereof.

6. The printing system of claim 1, wherein the airflow restriction mechanism comprises a plurality of the airflow impeding structures, each of the airflow impeding structures being positioned within one of the platen holes in the first group of platen holes.

7. The printing system of claim 1, wherein the first group of platen holes comprises platen holes that are located under the printhead.

8. The printing system of claim 1, wherein the second group of platen holes comprises those of the platen holes that are located in a region where print media are loaded onto and initially adhered to the movable support surface.

9. The printing system of claim 1, wherein the first group of platen holes comprises all those of the platen holes that are located under the printhead.

10. The printing system of claim 1, wherein the ink deposition assembly comprises a plurality of printheads, the printhead being one of the plurality of printheads, wherein the vacuum plenum comprises a plurality of airflow restriction mechanisms that form respective high impedance zones in the vacuum platen, the airflow restriction mechanism being one of the plurality of airflow restriction mechanisms;

wherein each of the high impedance zones corresponds to one of the printheads and comprises those of the platen holes that are located under the corresponding printhead.

11. The printing system of claim 1, wherein the movable support surface comprises a belt configured to move over a surface of the vacuum platen, the belt comprising belt holes through which the vacuum suction is communicated to the print medium.

12. The printing system of claim 1, wherein a percentage difference in suction force provided to the print medium by the first group and the second group is smaller than a percentage difference in the rate of airflow through the first group and the second group.

13. A printing system comprising:

an ink deposition assembly comprising a printhead arranged to eject a print fluid to a deposition region of the ink deposition assembly;

a media transport assembly comprising:

a vacuum source;

a vacuum plenum in fluidic communication with the vacuum source, the vacuum plenum comprising a vacuum platen comprising a first surface facing the ink deposition assembly and a second surface facing an interior of the vacuum plenum, wherein the vacuum platen comprises a plurality of opening in the first surface and a plurality of platen holes extending respectively through the vacuum platen to the second surface of the vacuum platen and fluidically coupling an interior of the vacuum plenum to the openings; and a movable support surface movable over the first surface of the vacuum platen, wherein the media transport assembly is configured hold a print medium against the movable support surface by vacuum suction communicated from the vacuum source through the platen holes to the movable support surface, wherein the vacuum plenum comprises an airflow restriction mechanism comprising one or more baffles at the second surface of the vacuum platen, the baffles comprising walls protruding from the vacuum platen into an interior of the vacuum plenum and defining a passageway having a first opening at the vacuum platen encompassing outlet openings of the first group of platen holes and a second opening opposite from the first opening and having less open cross-sectional area than the first opening.

14. The printing system of claim 13, wherein the first group of platen holes comprises platen holes that are located under the printhead and the second group of platen holes comprises platen holes located in a region where print media are loaded onto and initially adhered to the movable support surface.

15. The printing system of claim 13, wherein the first group of platen holes comprises each platen hole that is located under the printhead.

16. The printing system of claim 13, wherein a percentage difference in suction force provided to the print medium by the first group and the second group is smaller than a percentage difference in the rate of airflow through the first group and the second group.

17. A method, comprising:

loading a print medium onto a movable support surface of a media transport assembly of a printing system;

holding the print medium against the movable support surface via vacuum suction through platen holes of a vacuum platen;

transporting the print medium in a process direction through a deposition region of a printhead of the printing system by moving the movable support surface; and ejecting print fluid from the printhead to deposit the print fluid to the print medium in the deposition region, wherein creating the vacuum suction through the platen holes of the vacuum platen comprises:

flowing air through a first group of the platen holes when not covered by the print medium at a first flow rate, flowing air through a second group of the platen holes, differing from the first group of platen holes, when not covered by the print medium at a second flow rate higher than the first flow rate, the flowing the air through the second group of platen holes further comprising flowing the air through one or more air impedance structures mounted at fixed positions relative to the second group of platen holes.

18. The method of claim 17, wherein a percentage difference in suction force provided to the print medium by the first group and the second group is smaller than a percentage difference in the rate of airflow through the first group and the second group.

19. The method of claim 17, wherein the second group is located under the printhead.

20. The method of claim 17, wherein the first group is located at a region where the print medium is loaded onto the movable support surface.

21. The method of claim 17, wherein holding the print medium against the movable support surface via vacuum suction comprise impeding airflow through the second group more than airflow is impeded through the first group.

* * * * *